US011022404B2

(12) United States Patent
Echols

(10) Patent No.: US 11,022,404 B2
(45) Date of Patent: Jun. 1, 2021

(54) FIREARM AND SCOPE ALIGNMENT

(71) Applicant: 90° True North, LLC, Providence, UT (US)

(72) Inventor: D'Arcy Echols, Millville, UT (US)

(73) Assignee: 90° True North, LLC, Providence, UT (US)

( * ) Notice: Subject to any disclaimer, the term of this patent is extended or adjusted under 35 U.S.C. 154(b) by 0 days.

(21) Appl. No.: 16/916,478

(22) Filed: Jun. 30, 2020

(65) Prior Publication Data

US 2020/0333109 A1 Oct. 22, 2020

Related U.S. Application Data

(63) Continuation of application No. 16/288,020, filed on Feb. 27, 2019, now Pat. No. 10,767,964.

(51) Int. Cl.
*F41G 1/54* (2006.01)
*F41G 11/00* (2006.01)

(52) U.S. Cl.
CPC ..... *F41G 1/545* (2013.01); *F41G 11/001* (2013.01)

(58) Field of Classification Search
CPC ... F41G 1/387; F41G 1/44; F41G 1/54; F41G 1/545; F41G 3/323; F41G 3/32; F41G 11/001
USPC ..... 42/124–128, 106, 108, 120, 121; 359/430
See application file for complete search history.

(56) References Cited

U.S. PATENT DOCUMENTS

| | | | |
|---|---|---|---|
| 3,112,567 | A | 12/1963 | Flanagan |
| 4,090,305 | A | 5/1978 | Cassidy |
| 5,315,781 | A | 5/1994 | Beisner |
| 5,406,733 | A | 4/1995 | Tarlton et al. |
| 6,584,720 | B1 | 7/2003 | Johnson |
| 6,813,855 | B2 | 11/2004 | Pinkley |
| 8,695,266 | B2 | 4/2014 | Moore et al. |
| 8,819,985 | B1 | 9/2014 | McCoy et al. |
| 9,015,982 | B1 | 4/2015 | Powers |
| 9,170,067 | B2 | 10/2015 | McRee |
| 9,593,909 | B2 | 3/2017 | McRee |
| 9,777,992 | B2 | 10/2017 | McRee |
| 10,182,012 | B2 | 1/2019 | Minakuchi et al. |
| 10,578,402 | B1 | 3/2020 | McCoy, II |
| 2003/0117685 | A1 | 6/2003 | Dewa |
| 2003/0177685 | A1 | 9/2003 | Pinkley |
| 2007/0113460 | A1 | 5/2007 | Potterfield et al. |
| 2007/0144051 | A1 | 6/2007 | Moore et al. |
| 2012/0260555 | A1 | 10/2012 | Potterfield et al. |

*Primary Examiner* — Jonathan C Weber
(74) *Attorney, Agent, or Firm* — Maywood IP Law; David Meibos

(57) ABSTRACT

Systems for leveling a firearm receiver and aligning a scope to the receiver are precisely fabricated and assembled to maximize accuracy, including high sensitivity spirit levels. A bar assembly with a high sensitivity spirit level is received in the receiver with the bar in direct contact with the receiver rails. The bar may directly contact the full length of the receiver rails. A plate assembly includes a lower plate for connection to a bench rest, an upper plate for connection to the receiver, and a mechanism to pivot the upper plate relative to the lower plate about a pivot axis for windage adjustment. Methods of use are disclosed.

20 Claims, 22 Drawing Sheets

FIREARM AND SCOPE ALIGNMENT

CROSS-REFERENCE TO RELATED APPLICATIONS

This application is a continuation of pending U.S. patent application Ser. No. 16/288,080, filed Feb. 27, 2019, and is entitled FIREARM AND SCOPE ALIGNMENT.

The above-identified document is incorporated herein by reference.

TECHNICAL FIELD

The present disclosure relates to apparatus and methods for aligning a firearm barrel axis and a scope axis precisely in a common plane that is truly vertical, and aligning the vertical and horizontal scope reticles to be truly vertical and horizontal.

BACKGROUND

Precisely vertical and horizontal rifle scope crosshairs, or reticles, become increasingly important to shot accuracy as the downrange distance increases. A slight cant, or angle error, in the crosshairs can cause noticeable error or missed shots at long distances. A cant of five degrees may cause an error of 3.7 inches at 300 yards.

Stated another way, the firearm barrel axis, along which the projectile travels, must lie in a common vertical plane with the scope axis, along which the shooter sights the target. However, when the firearm is properly sighted in, the barrel axis is not parallel to the scope axis. The barrel axis must be tilted with the muzzle up (elevation) in order to counteract gravitational drop of the projectile during its flight time to the target. However, the scope axis is usually truly horizontal. When the barrel and scope axes lie in a non-vertical plane, the barrel axis elevation angle causes the projectile to miss low to the right or left of the target.

Numerous devices have been developed with the goal of aligning a firearm barrel axis and a scope axis precisely in a common vertical plane and aligning the vertical and horizontal scope reticles to be truly vertical and horizontal. Many of these devices incorporate spirit levels. Some examples include the Weaver Crosshair Leveling Kit, the Straight Shot Segway Reticle Kit and the Wheeler Pro Reticle Leveling Kit. There are at least two shortcomings with devices such as these: 1) inadequate means for mounting the devices to the firearm or scope and 2) low precision fabrication of the devices, in particular low sensitivity spirit levels.

The means for mounting the devices to the firearm or scope may be inadequate for several reasons. Devices may make contact with firearm or scope features or surfaces which are not reliably and precisely oriented with respect to the barrel axis, the scope axis, and/or the vertical plane for alignment. Devices may be fabricated with compliant parts, such as a magnetic pad, for primary contact with the firearm or scope. Devices may have relatively small contact areas or contact lengths with the firearm or scope features.

Devices may be fabricated with conventional industry tolerances for production parts, or in some instances tolerances that may be wider than industry standard. In an assembly, the tolerances may stack up unfavorably, resulting in low precision.

There is a need for apparatus and methods which overcome these drawbacks by incorporating means for mounting the apparatus to reliable precision machined surfaces of the firearm or scope, which surfaces have known, consistent orientations relative to the barrel axis, the scope axis, and/or the vertical plane for alignment. There is also a need for apparatus and methods with high precision, for example components fabricated and assembled to gage makers tolerances, and high sensitivity spirit levels.

SUMMARY

The various systems and methods of the present technology have been developed in response to the present state of the art, and in particular, in response to the problems and needs in the art that have not yet been fully solved by currently available firearm/scope alignment and leveling technologies. The systems and methods of the present technology may provide enhanced means for mounting the associated apparatus to a firearm or scope and enhanced precision of parts, assemblies, and methods of use.

To achieve the foregoing, and in accordance with the technology as embodied and broadly described herein, in an aspect of the technology, a system for leveling a firearm receiver, wherein the receiver includes a central longitudinal axis, a cavity, an ejection window, and a magazine window, wherein the cavity extends longitudinally into a back end of the receiver and includes a first planar datum surface that is parallel to the central longitudinal axis, wherein the ejection window extends into the cavity through an upper portion of the receiver between an ejection window front wall and an ejection window back wall, wherein the magazine window extends into the cavity through a bottom side of the receiver between a magazine window front wall and a magazine window back wall, the system includes: a bar assembly including a bar and a first level, wherein the bar assembly is removably connectable to the receiver; wherein the bar extends between a front end and an opposite back end, wherein the bar includes a second planar datum surface that extends between the front and back ends; wherein the first level is fixed to the bar and is level with respect to the second planar datum surface; wherein when the bar assembly is connected to the receiver, the first and second planar datum surfaces are in direct contact, the bar front end is in front of the ejection window front wall or the magazine window front wall, and the bar back end is behind the ejection window back wall or the magazine window back wall.

Embodiments of this aspect may include one or more of the following attributes. The first planar datum surface extends between a first front edge and an opposite first back edge; wherein the second planar datum surface extends between a second front edge and an opposite second back edge; wherein, when the bar assembly is connected to the receiver, the second front edge is in front of the first front edge, and the second back edge is behind the first back edge. When the bar assembly is connected to the receiver, the second planar datum surface is in direct contact with at least 40% of the first planar datum surface. The first level is a bullseye spirit level, wherein the first level is omnidirectionally level with respect to the second planar datum surface. The bar assembly includes a second level that is fixed to the bar and is level with respect to the second planar datum surface, wherein the second level is a tube spirit level; wherein when the bar assembly is connected to the receiver, the second level is elongated along a direction that is perpendicular to the receiver central longitudinal axis. The system further including: a plate assembly including a lower plate, an upper plate, and a windage fine adjustment mechanism; wherein the lower plate is removably connectable to a main column of a firearm bench rest; wherein the upper plate is removably connectable to the receiver; wherein the windage fine adjustment mechanism is actuatable to pivot the upper plate right or left relative to the lower plate about a pivot axis. When the receiver is connected to the upper plate, the receiver central longitudinal axis intersects the pivot axis.

In another aspect of the technology, a system for leveling a firearm receiver, wherein the receiver includes a central longitudinal axis and a cavity, wherein the cavity extends longitudinally into a back end of the receiver and includes a first planar datum surface that is parallel to the central longitudinal axis, wherein the first planar datum surface extends between a first front edge and an opposite first back edge, wherein a first distance extends parallel to the central longitudinal axis between the first front and back edges, the system includes: a bar assembly including a bar and a first level, wherein the bar assembly is removably connectable to the receiver; wherein the bar includes a second planar datum surface that extends between a second front edge and an opposite second back edge; wherein the first level is fixed to the bar and is level with respect to the bar second planar datum surface; wherein when the bar assembly is connected to the receiver, the first and second planar datum surfaces are in direct contact, a second distance extends parallel to the central longitudinal axis between the second front and back edges, wherein the second distance is at least 50% of the first distance.

Embodiments of this aspect may include one or more of the following attributes. When the bar assembly is connected to the receiver, the second front edge is in front of the first front edge, and the second back edge is behind the first back edge. When the bar assembly is connected to the receiver, the second planar datum surface is in direct contact with at least 40% of the first planar datum surface. The first level is a bullseye spirit level, wherein the first level is omnidirectionally level with respect to the second planar datum surface. The bar assembly includes a second level that is fixed to the bar and is level with respect to the second planar datum surface, wherein the second level is a tube spirit level; wherein when the bar assembly is connected to the receiver, the second level is elongated along a direction that is perpendicular to the receiver central longitudinal axis. The system further including: a plate assembly including a lower plate, an upper plate, and a windage fine adjustment mechanism; wherein the lower plate is removably connectable to a main column of a firearm bench rest; wherein the upper plate is removably o connectable to the receiver; wherein the windage fine adjustment mechanism is actuatable to pivot the upper plate right or left relative to the lower plate about a pivot axis. When the receiver is connected to the upper plate, the receiver central longitudinal axis intersects the pivot axis.

In yet another aspect of the technology, a method of leveling a firearm receiver, wherein the receiver includes a central longitudinal axis, a cavity, an ejection window, and a magazine window, wherein the cavity extends longitudinally into a back end of the receiver and includes a first planar datum surface that is parallel to the central longitudinal axis, wherein the ejection window extends into the cavity through an upper portion of the receiver between an ejection window front wall and an ejection window back wall, wherein the magazine window extends into the cavity through a bottom side of the receiver between a magazine window front wall and a magazine window back wall, the method includes the steps of: providing a bar assembly including a bar and a first level, wherein the bar extends between a front end and an opposite back end, and includes a second planar datum surface that extends between the front and back ends, wherein the first level is fixed to the bar and is level with respect to the second planar datum surface, wherein the first level includes a first bubble; coupling the bar assembly to the receiver so that the first and second planar datum surfaces are in direct contact, the bar front end is in front of the ejection window front wall or the magazine window front wall, and the bar back end is behind the ejection window back wall or the magazine window back wall; and adjusting the orientation of the receiver so that the first bubble is centered in the first level.

Embodiments of this aspect may include one or more of the following attributes. The method, further including the steps of: coupling a scope to the receiver, wherein the scope includes a vertical reticle; providing a true vertical datum downrange of the receiver; and after adjusting the orientation of the receiver so that the first bubble is centered in the first level, adjusting the orientation of the scope to align the vertical reticle to the true vertical datum while maintaining the first bubble centered in the first level; and fixing the scope to the receiver while maintaining the first bubble centered in the first level and the vertical reticle aligned to the true vertical datum. The first planar datum surface extends between a first front edge and an opposite first back edge, wherein the second planar datum surface extends between a second front edge and an opposite second back edge, the method further including the steps of: coupling the bar assembly to the receiver so that the second front edge is in front of the first front edge, and the second back edge is behind the first back edge. The method, further including the steps of: coupling the bar assembly to the receiver so that the second planar datum surface is in direct contact with at least 40% of the first planar datum surface. The method, further including the steps of: providing a plate assembly including a lower plate, an upper plate, and a windage fine adjustment mechanism, wherein the windage fine adjustment mechanism is actuatable to pivot the upper plate right or left relative to the lower plate about a pivot axis; coupling the lower plate to a main column of a firearm bench rest; and coupling the upper plate to the receiver; wherein adjusting the orientation of the receiver so that the first bubble is centered in the first level includes adjusting the elevation of the receiver central longitudinal axis by adjusting the bench rest, and adjusting the windage of the receiver central longitudinal axis by adjusting the windage fine adjustment mechanism. The first level is a bullseye spirit level, wherein adjusting the orientation of the receiver so that the first bubble is centered in the first level includes omnidirectionally adjusting the orientation of the receiver, the method further including the steps of: coupling a scope to the receiver, wherein the scope includes a vertical reticle; providing a true vertical datum downrange of the receiver; and after adjusting the orientation of the receiver so that the first bubble is centered in the first level, adjusting the orientation of the scope to align the vertical reticle to the true vertical datum while maintaining the first bubble centered in the first level; and fixing the scope to the receiver while maintaining the first bubble centered in the first level and the vertical reticle aligned to the true vertical datum.

These and other features and advantages of the present technology will become more fully apparent from the following description and appended claims, or may be learned by the practice of the technology as set forth hereinafter.

BRIEF DESCRIPTION OF THE DRAWINGS

Exemplary embodiments of the technology will become more fully apparent from the following description and appended claims, taken in conjunction with the accompanying drawings. Understanding that these drawings depict only exemplary embodiments and are, therefore, not to be considered limiting of the scope of the technology, the exemplary embodiments will be described with additional specificity and detail through use of the accompanying drawings in which:

DETAILED DESCRIPTION

Figure 1:
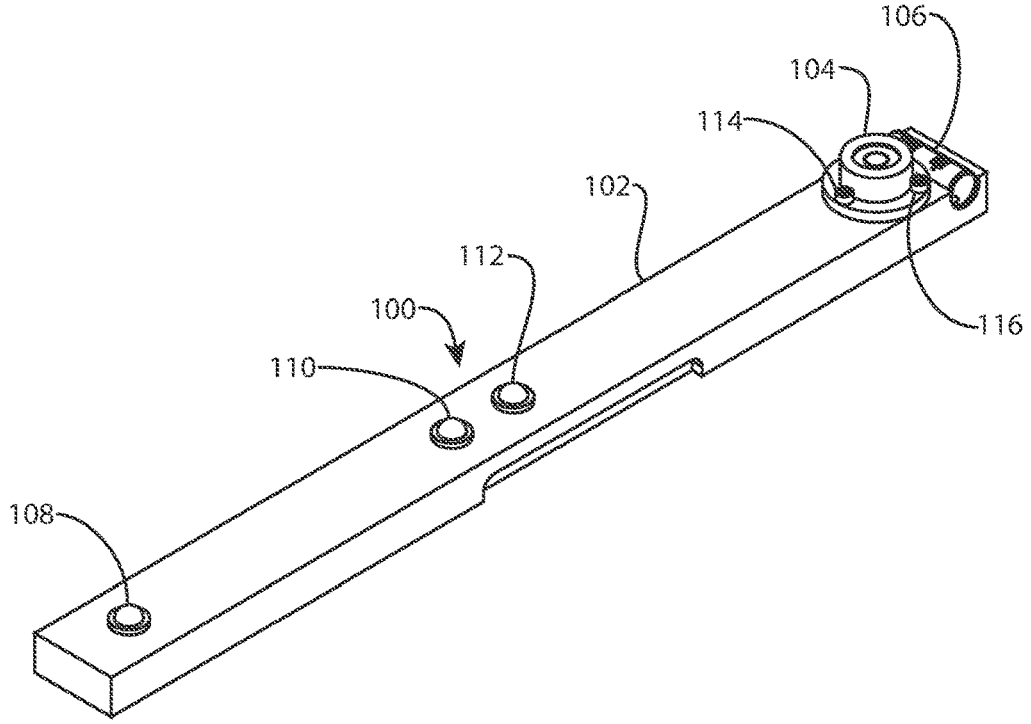
FIG. 1 is a perspective view of a first assembly, referred to as a reticle bar.
Figure 2:
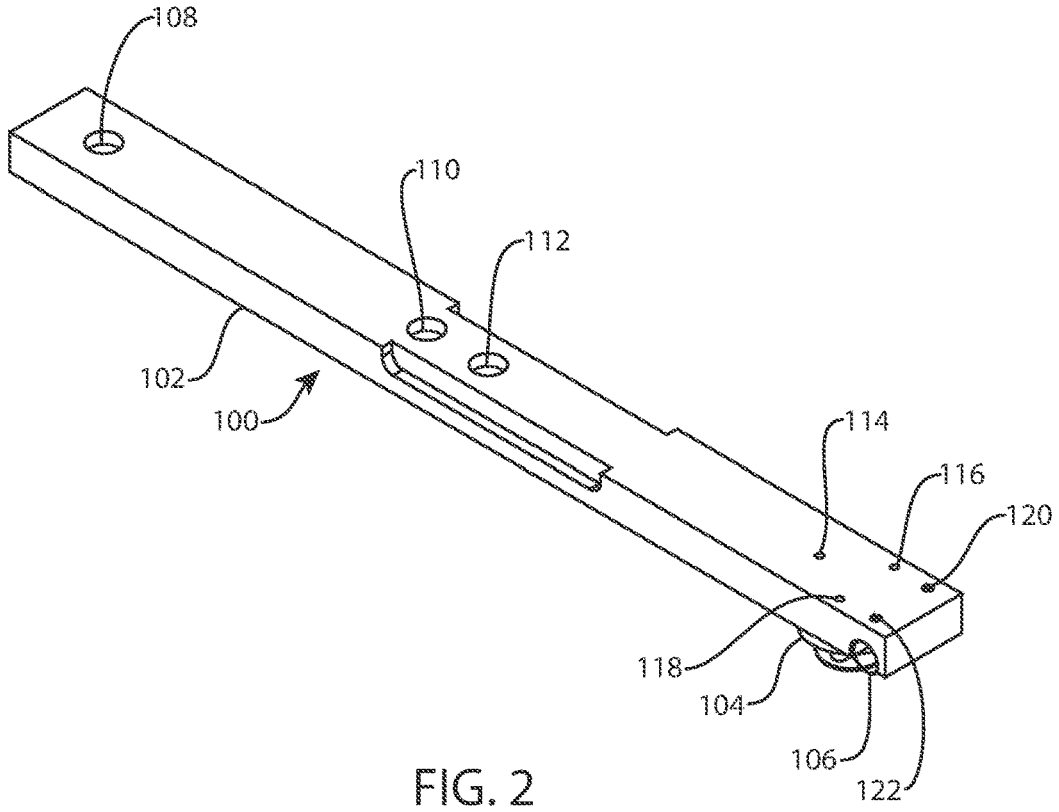
FIG. 2 is another perspective view of the first assembly of FIG. 1 from a different direction.
Figure 3:
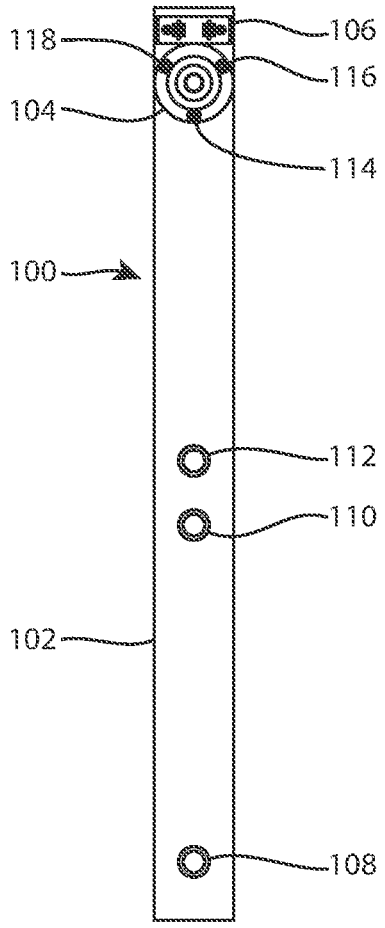
FIG. 3 is a top view of the first assembly of FIG. 1.
Figure 4:
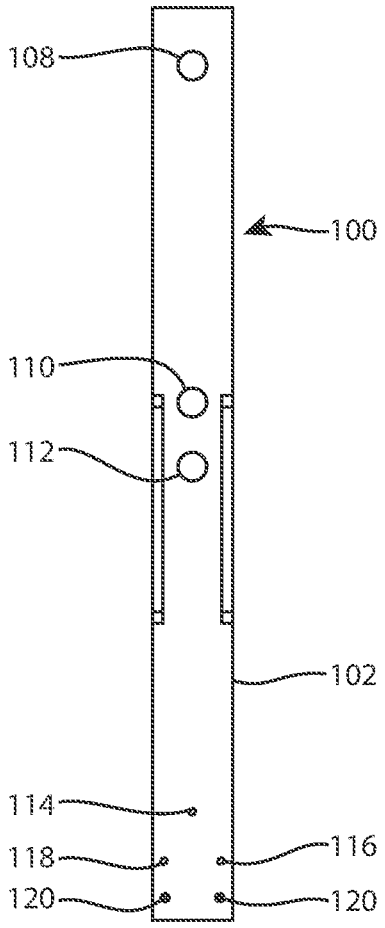
FIG. 4 is a bottom view of the first assembly of FIG. 1.
Figure 5:
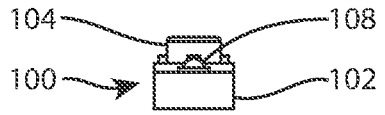
FIG. 5 is a front view of the first assembly of FIG. 1.
Figure 6:
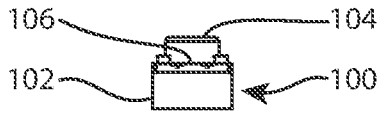
FIG. 6 is a back view of the first assembly of FIG. 1.

Exemplary embodiments of the technology will be best understood by reference to the drawings, wherein like parts are designated by like numerals throughout. It will be readily understood that the components of the technology, as generally described and illustrated in the figures herein, could be arranged and designed in a wide variety of different configurations. Thus, the following more detailed description of the embodiments of the apparatus, system, and method is not intended to limit the scope of the invention, as claimed, but is merely representative of exemplary embodiments of the technology.

The phrases "connected to," "coupled to" and "in communication with" refer to any form of interaction between two or more entities, including mechanical, electrical, magnetic, electromagnetic, fluid, and thermal interaction. Two components may be functionally coupled to each other even though they are not in direct contact with each other. The term "abutting" refers to items that are in direct physical contact with each other, although the items may not necessarily be attached together. The phrase "fluid communication" refers to two features that are connected such that a fluid within one feature is able to pass into the other feature.

The word "exemplary" is used herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

Standard firearm planes of reference, directional terms, and descriptive terminology are employed in this specification with their ordinary and customary meanings. "Front" or "muzzle," "rear" or "back" or "breech," "left," "right," "top" or "up," and "bottom" or "down" are defined from the point of view of a shooter in a conventional shooting position relative to an apparatus or a part. "Downrange" means in front of the apparatus at a distance representative of a planned distance to target. A firearm has a barrel axis, or shooting axis, which is the central longitudinal axis of the barrel, along which a bullet travels as it is fired from the firearm. A scope has a scope axis, or sighting axis, which is the central longitudinal axis of the scope, along which a shooter sights on a target. When the firearm and scope are properly aligned, the barrel axis and the scope axis lie in a common vertical plane. Typically, the scope axis is above the barrel axis.

"Gage makers tolerance," abbreviated as "GMT," is defined in this specification as a tolerance much smaller than conventional industry tolerances for production parts. GMTs are conventionally used in fabrication of the gages used to inspect production parts. ASME B89 is one example of a standard for dimensional metrology which sets forth specification of dimensional measuring instruments and gages for measuring various geometrical characteristics such as lengths, plane surfaces, angles, circles, cylinders, cones, spheres, and tori.

Referring to FIGS. 1-10, a first assembly 100 may include a base 102, a bullseye level 104, a tube level 106, a roller 108, a screw 114, and a set screw 120. Three rollers 108, 110, 112; three screws 114, 116, 118; and two set screws 120, 122 are shown. The first assembly 100 may be referred to as a reticle bar, reticle assembly, or bar assembly.

Figure 7:
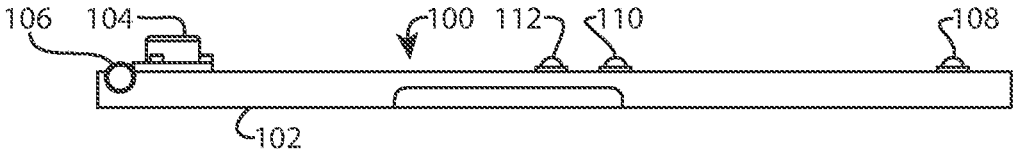
FIG. 7 is a left view of the first assembly of FIG. 1.
Figure 8:
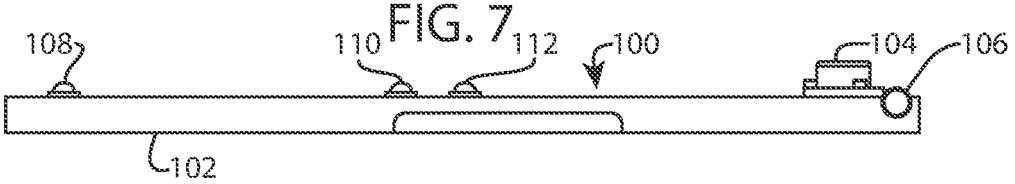
FIG. 8 is a right view of the first assembly of FIG. 1.
Figure 9:
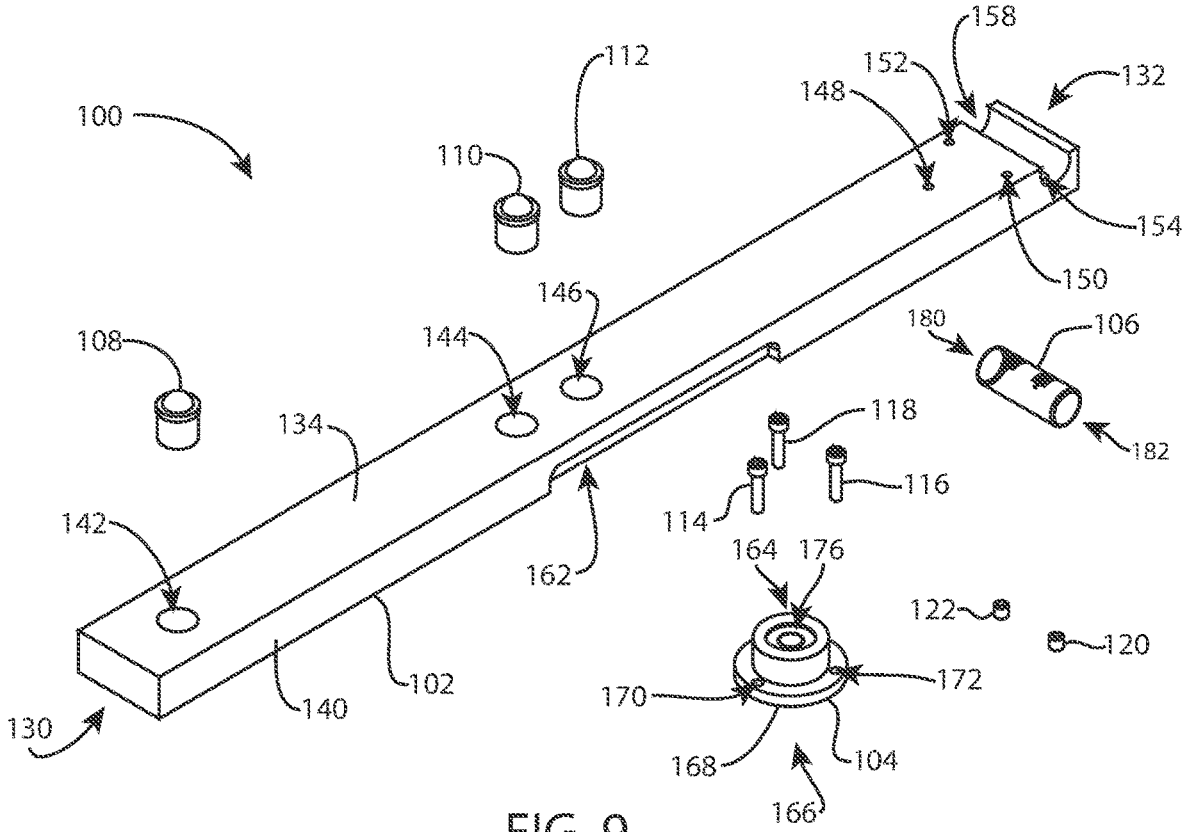
FIG. 9 is an exploded perspective view of the first assembly of FIG. 1.
Figure 10:
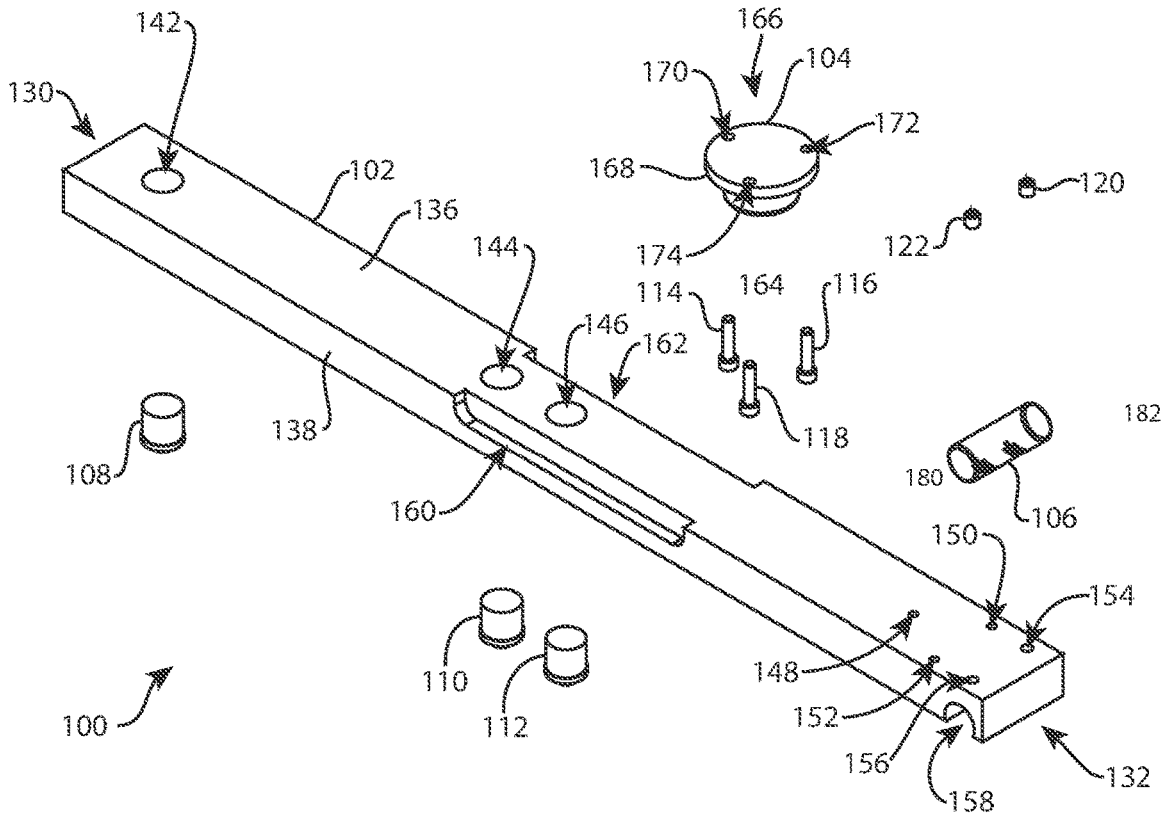
FIG. 10 is another exploded perspective view of the first assembly of FIG. 1 from a different direction.
Figure 11:
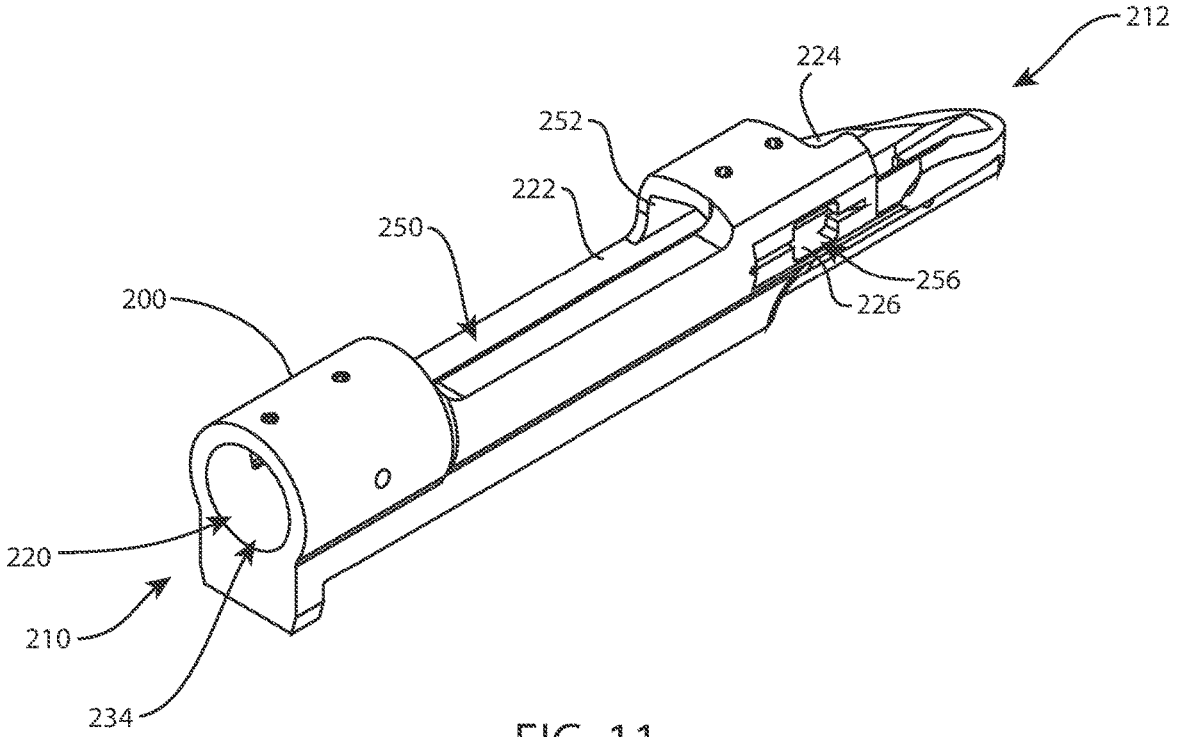
FIG. 11 is a perspective view of a receiver.
Figure 12:
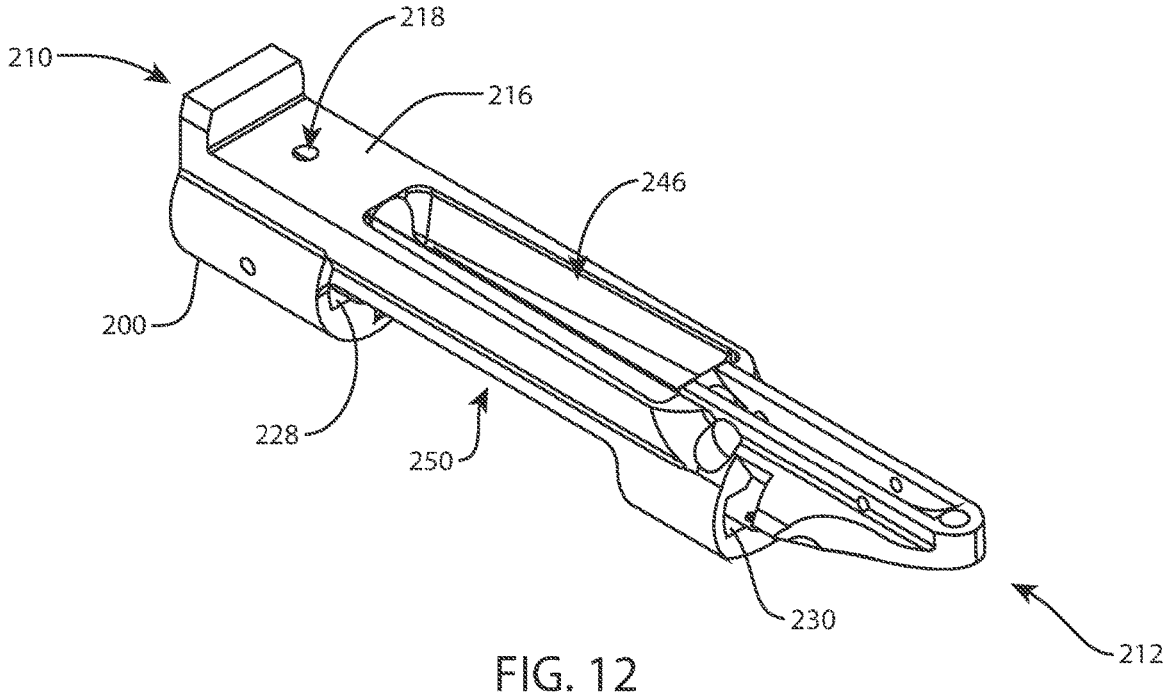
FIG. 12 is another perspective view of the receiver of FIG. 11 from a different direction.
Figure 13:
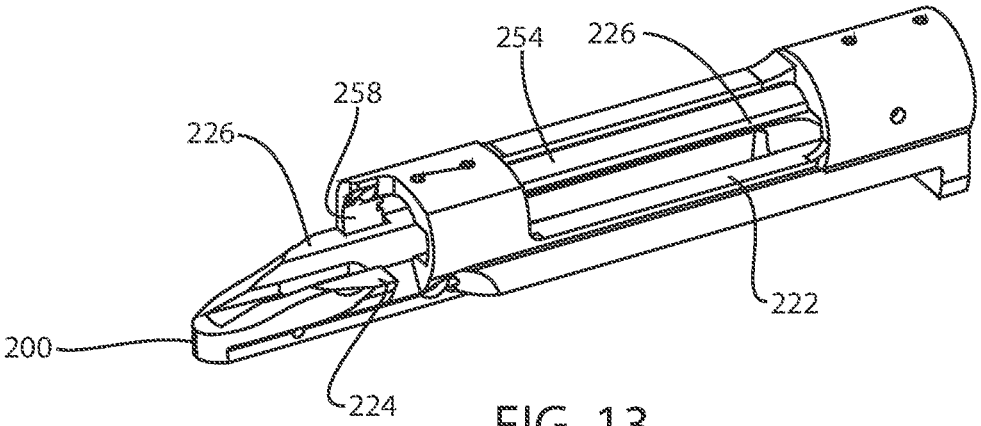
FIG. 13 is another perspective view of the receiver of FIG. 11 from a different direction.
Figure 14:
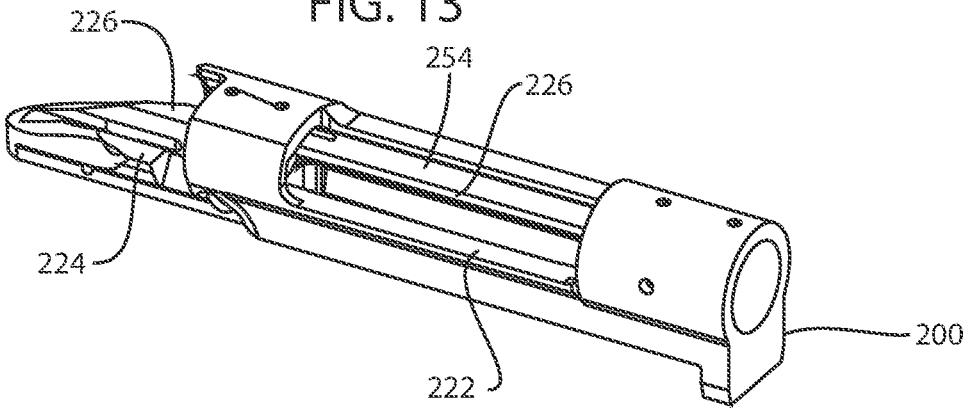
FIG. 14 is another perspective view of the receiver of FIG. 11 from a different direction.
Figure 15:
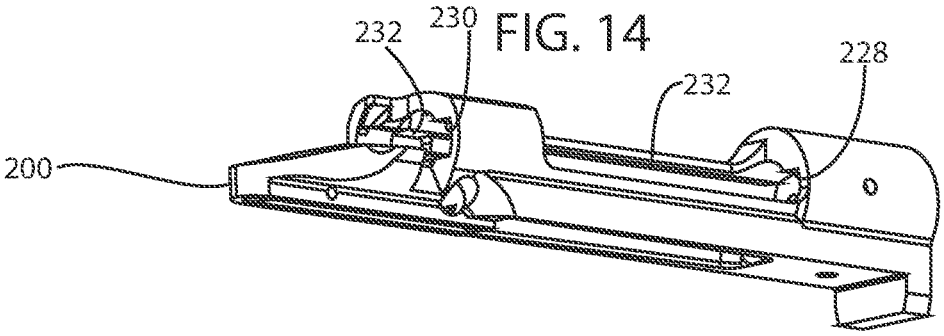
FIG. 15 is another perspective view of the receiver of FIG. 11 from a different direction.
Figure 16:
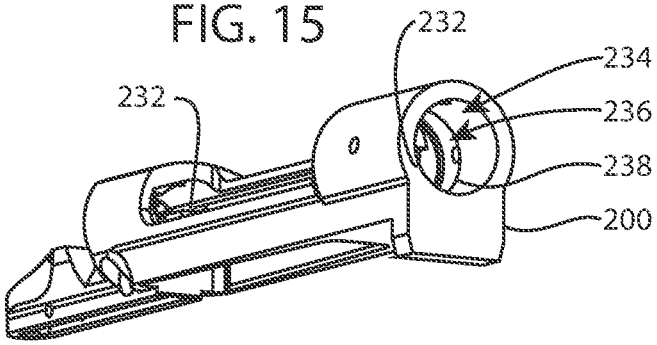
FIG. 16 is another perspective view of the receiver of FIG. 11 from a different direction.
Figure 24:
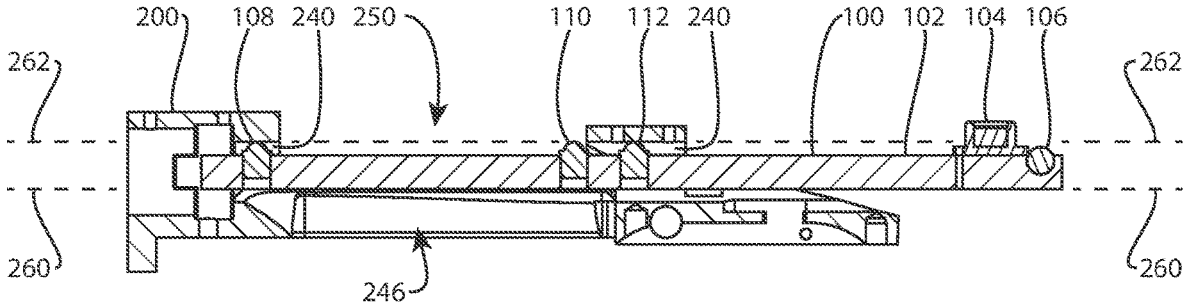
FIG. 24 is a cross-sectional view of the first assembly and receiver of FIG. 20, taken along section line 24-24 of FIG. 22.
Figure 25:
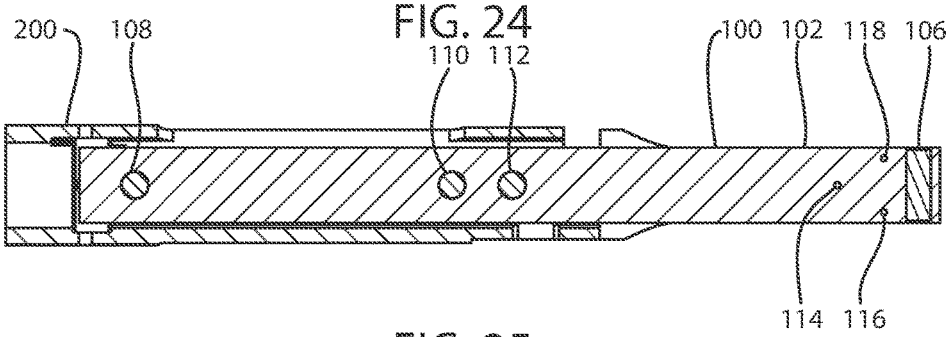
FIG. 25 is a cross-sectional view of the first assembly and receiver of FIG. 20, taken along section line 25-25 of FIG. 23.
Figure 26:
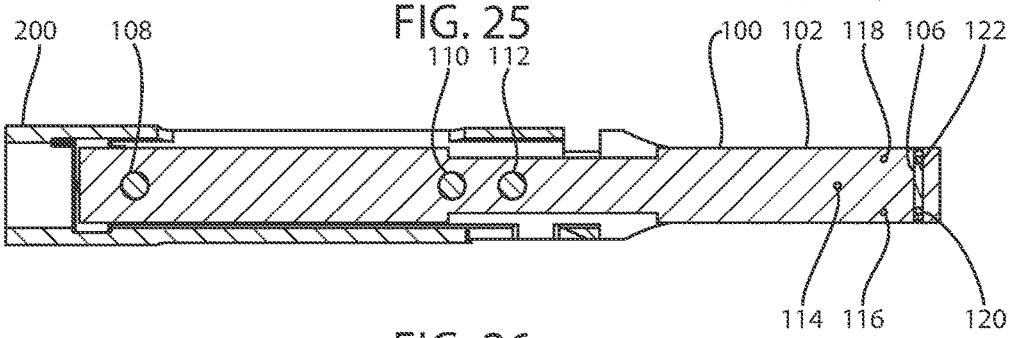
FIG. 26 is a cross-sectional view of the first assembly and receiver of FIG. 20, taken along section line 26-26 of FIG. 23.
Figure 27:
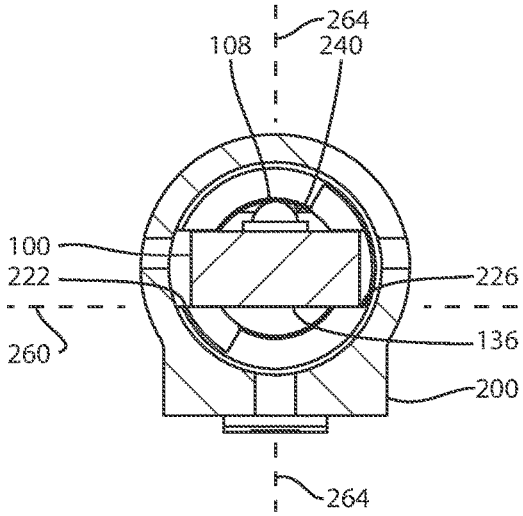
FIG. 27 is a cross-sectional view of the first assembly and receiver of FIG. 20, taken along section line 27-27 of FIG. 23.
Figure 28:
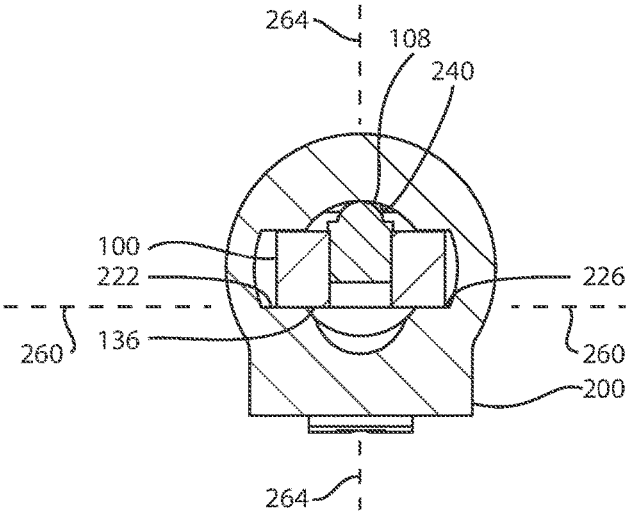
FIG. 28 is a cross-sectional view of the first assembly and receiver of FIG. 20, taken along section line 28-28 of FIG. 23.
Figure 29:
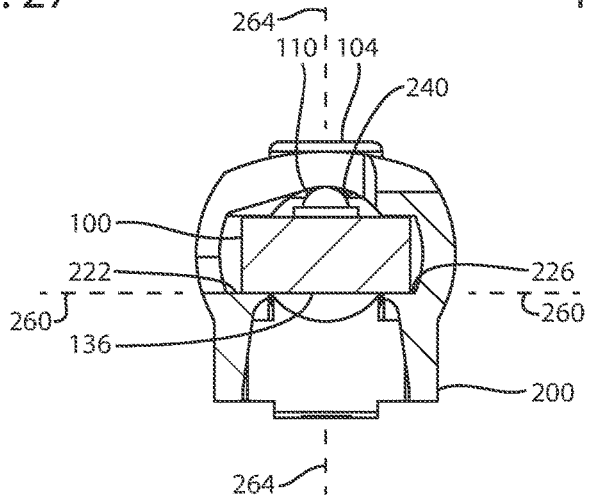
FIG. 29 is a cross-sectional view of the first assembly and receiver of FIG. 20, taken along section line 29-29 of FIG. 23.
Figure 30:
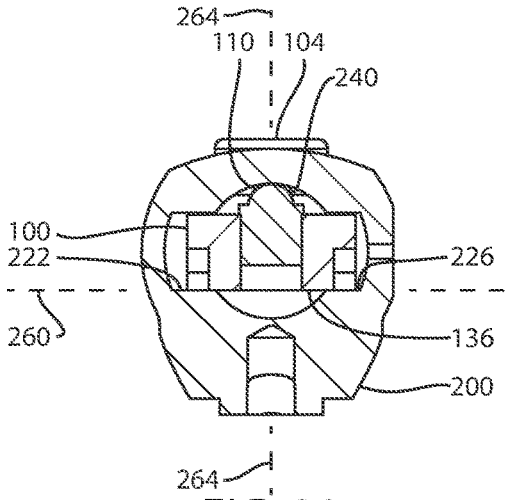
FIG. 30 is a cross-sectional view of the first assembly and receiver of FIG. 20, taken along section line 30-30 of FIG. 23.
Figure 31:
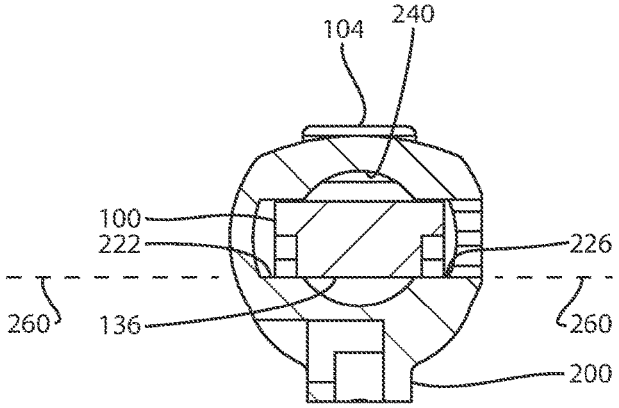
FIG. 31 is a cross-sectional view of the first assembly and receiver of FIG. 20, taken along section line 31-31 of FIG. 23.

The base 102 may be a long, thin, substantially rectangular bar that is elongated between a front end 130 and a back end 132. The base 102 has a top side 134, a bottom side 136, a right side 138, and a left side 140. First, second, and third holes 142, 144, 146 may extend through the base 102 between the top and bottom sides 134, 136. The holes 142, 144, 146 may be centered in the right-left width of the base 102. The first hole 142 may be near the front end 130. The second and third holes 144, 146 may be close together, about halfway between the front and back ends 130, 132, with the second hole closer to the front end and the third hole closer to the back end. The holes 142, 144, 146 may be internally threaded. A triangular group of three holes 148, 150, 152 may extend through the base 102 between the top and bottom sides 134, 136. The holes 148, 150, 152 may be close together near the back end 132, with the hole 148 centered in the right-left width of the base 102 and closer to the front end 130 and the holes 150, 152 side by side closer to the back end. The hole 150 may be closer to the left side 140 and the hole 152 may be closer to the right side 138. A pair of holes 154, 156 may extend through the base 102 between the top and bottom sides 134, 136. The holes 154, 156 may be closer to the back end than the holes 150, 152. The hole 154 may be closer to the left side 140 and the hole 156 may be closer to the right side 138. A transverse groove 158 may extend into the base 102 from the top side 134 and across the base between the right and left sides 138, 140. The groove 158 may have a circular cross-sectional shape when viewed in a right or left view. The center of the circular cross-sectional shape may be recessed below the top side 134 so that the groove 158 is undercut (FIGS. 7, 8, 24). A longitudinal notch 160 may extend into the base 102 along the edge between the bottom and right sides 136, 138. The front end of the notch 160 may be close to the front side of the hole 144. The back end of the notch 160 may be between the hole 146 and the hole 148. The notch 160 may have a rectangular cross-sectional shape when viewed in a front or back view. Another longitudinal notch 162 may extend into the base 102 along the edge between the bottom and left sides 136, 140. The notch 162 may be a mirror image of the notch 160.

The bullseye level 104 may be a cylindrical part with a top end 164 and a bottom end 166. The bullseye level 104 may be referred to as a circular spirit level or an omnidirectional spirit level. An enlarged flange 168 may extend around the bottom end. A triangular group of three holes 170, 172, 174 may extend through the flange 168 between the top and bottom ends 164, 166. The bullseye level 104 includes a fluid reservoir 176 with a clear wall across the top end. The fluid reservoir includes a bubble of air or other gas that is movable within the fluid. The clear top wall may include indicia, such as concentric circular marks, to aid the user in centering the bubble and thus leveling the bullseye level 104. The clear top wall is preferably made of glass. Geier & Bluhm of New York manufactures a bullseye level that the inventor finds suitable.

The tube level 106 may be an elongated clear part that extends between a right end 180 and a left end 182. While the tube level 106 may appear to be a cylindrical part, it may actually have an oval shape, a barrel shape, or another curved shape of its side wall in a front or back view. The curvature may be subtle, in other words, it may have a large radius of curvature. The tube level 106 is a fluid reservoir with a bubble of air or other gas that is movable within the fluid. The tube level 106 may include indicia, such as transverse lines, to aid the user in centering the bubble and thus leveling the tube level. The tube level 106 is preferably made of glass. W. A. Moyer of Kansas manufactures a tube level that the inventor finds suitable.

The "sensitivity" of a spirit level refers to how easily the bubble moves within the fluid reservoir when the spirit level is tilted. Greater sensitivity equates to a more precise spirit level. Sensitivity may be measured in millimeters per meter (mm/m) or arcminute (arcmin). The standard for most spirit levels on the market is a sensitivity of 10 mm/m. Preferably, the bullseye level 104 and the tube level 106 are high precision parts with sensitivities less than 10 mm/m, for example 5 mm/m, 2 mm/m, or 1 mm/m.

The roller 108 may be a ball nose spring plunger or other compliant component. The roller 108 may be externally threaded. The rollers 110, 112 may be identical to the roller 108.

The screw 114 may be a socket head cap screw. The screws 116, 118 may be identical to the screw 114.

The set screw 120 may be a cup point socket set screw. The set screw 122 may be identical to the set screw 120.

The first assembly 100 may be operatively assembled by inserting the roller 108 into the hole 142 of the base 102 with the ball nose protruding from the top side 134; inserting the roller 110 into the hole 144 with the ball nose protruding from the top side 134; inserting the roller 112 into the hole 146 with the ball nose protruding from the top side 134; coupling the bullseye level 104 to the base 102 by inserting the screw 114 through the hole 170 and into the hole 148, inserting the screw 116 through the hole 172 and into the hole 150, and inserting the screw 118 through the hole 174 and into the hole 152; and coupling the tube level 106 to the base 102 by sliding the tube level into the groove 158 from the right or left side 138, 140, inserting the set screw 120 into the hole 154 to press against the bottom side of the tube level, and inserting the set screw 122 into the hole 156 to press against the bottom side of the tube level. Inserting the rollers 108, 110, 112 into the corresponding holes 142, 144, 146 may involve threading the rollers into the holes or press-fitting the rollers into the holes. Coupling the bullseye level 104 and/or the tube level 106 to the base 102 may include precisely leveling the bullseye level and/or the tube level to the bottom side 136 of the base 102, for example by adjusting the screws 114, 116, 118 and/or set screws 120, 122 to center the bubble(s) to GMT while the bottom side 136 rests upon a precision datum surface such as a calibrated granite surface plate. A surface plate is a solid, flat plate commonly used as the main horizontal reference plane for precision inspection, layout, and tooling setup.

When the first assembly 100 is operatively assembled, the bullseye level 104 and the tube level 106 may be precisely leveled with respect to the bottom side 136 of the base 102. The tops of the rollers 108, 110, 112 may be precisely positioned at a specific distance from the bottom side 136. Thus, the bottom side 136 may function as a primary planar datum surface of the first assembly 100.

Referring to FIGS. 11-19, a receiver 200 is shown. The illustrated receiver 200 is a flat bottomed Mod-70 which includes certain features that are common to many receivers. Only those features which interact with components of the current technology will be described herein.

The receiver 200 extends between a front end 210 and a back end 212. A central longitudinal axis 214 extends between the front and back ends 210, 212. When the receiver 200 is operatively assembled into a firearm, the axis 214 extends along the center of the barrel. Thus the axis 214 is the barrel axis or shooting axis of the receiver 200. The exterior of the receiver 200 includes a flat bottom surface 216 with an internally threaded hole 218 that extends up through the bottom surface 216 into the receiver 200 near the front end 210. The hole 218 may be referred to as a front guard screw hole. The interior of the receiver 200 includes a longitudinal cavity 220. The cavity includes a front right lower planar surface 222, a rear right lower planar surface 224, and a left lower planar surface 226. In the example shown, the front right lower planar surface 222 has an area of 1007 $mm^2$ and a 135 mm length measured parallel to the axis 214, the rear right lower planar surface 224 has an area of 142 $mm^2$ and a 22 mm length parallel to the axis 214, and the left lower planar surface 226 has an area of 808 $mm^2$ and a 167 mm length parallel to the axis 214. The lower planar surfaces 222, 224, 226 may be coplanar, and may be referred to as lower rails. The lower planar surfaces 222, 224, 226 may be parallel to the axis 214. The lower planar surfaces 222, 224, 226 are reliable precision machined surfaces which are excellent primary datum features for the disclosed technology. Taken together, the lower planar surfaces 222, 224, 226 may be treated as a single lower planar datum surface 221. In the example shown, the lower planar datum surface 221 has an area of 1957 $mm^2$ and a 169 mm overall length measured parallel to the axis 214. The cavity 220 includes a front right upper planar surface 228, a rear right upper planar surface 230, and a left upper planar surface 232. The upper planar surfaces 228, 230, 232 may be coplanar, and may be referred to as upper rails. The upper planar surfaces 228, 230, 232 are reliable precision machined surfaces which are excellent primary datum features for the disclosed technology. Taken together, the upper planar surfaces 228, 230, 232 may be treated as a single upper planar datum surface 227. The upper planar surfaces 228, 230, 232 may be parallel to the lower planar surfaces 222, 224, 226. Taken together, the lower and upper rails may be referred to as a bolt raceway. The cavity 220 includes a first cylindrical portion 234 which extends rearwardly into the front end 210 and a second cylindrical portion 236 which extends rearwardly from the first cylindrical portion 234 and concentric with the first cylindrical portion. The first cylindrical portion 234 receives a barrel (indicated in dashed lines in FIG. 43). The diameter of the second cylindrical portion 236 may be greater than the diameter of the first cylindrical portion 234, so that a rear-facing annular wall 238 is formed between the first and second cylindrical portions 234, 236.

Figure 17:
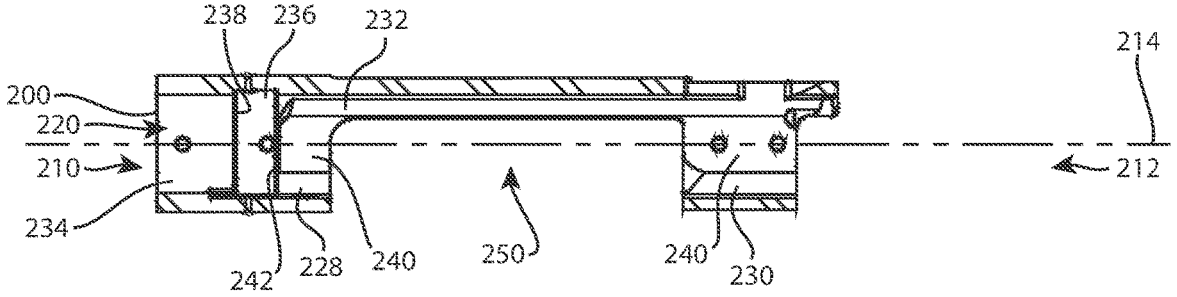
FIG. 17 is a cross-sectional view of a top half of the receiver of FIG. 11, taken along section line 17-17 of FIG. 18.
Figure 18:
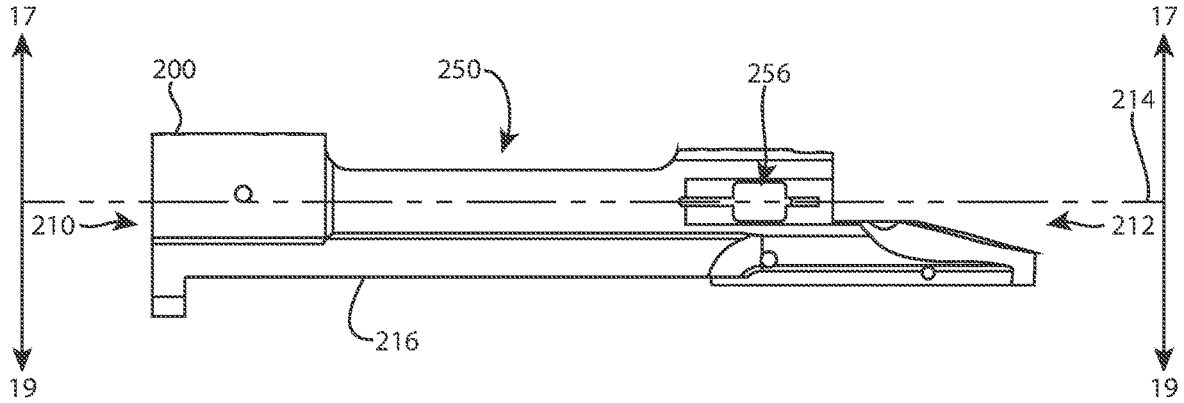
FIG. 18 is a right view of the receiver of FIG. 11.
Figure 19:
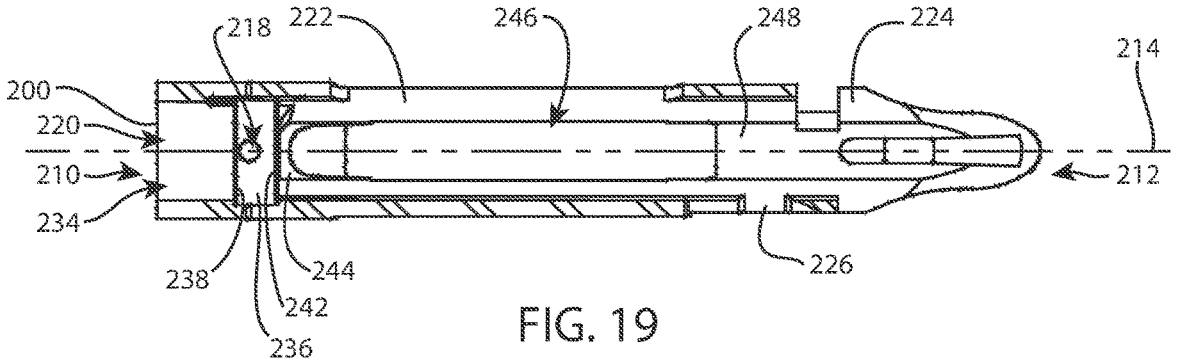
FIG. 19 is a cross-sectional view of a bottom half of the receiver of FIG. 11, taken along section line 19-19 of FIG. 18.
Figure 20:
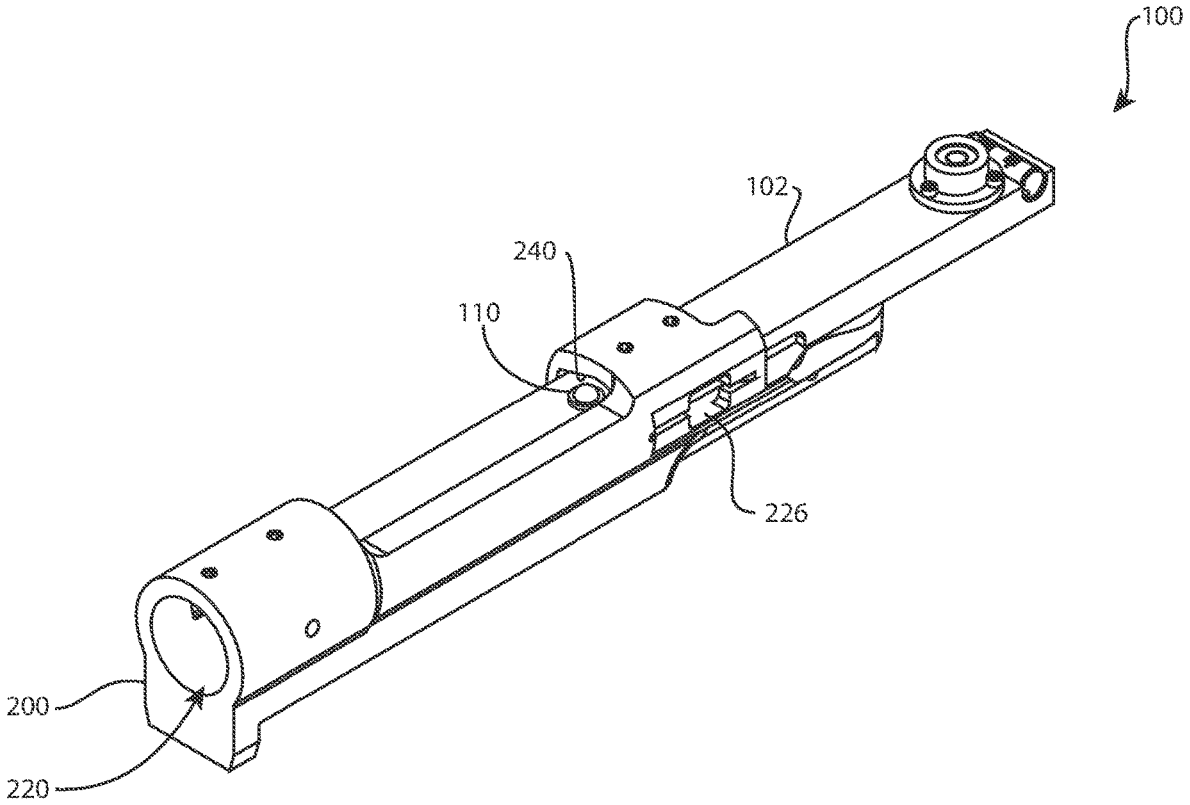
FIG. 20 is a perspective view of the first assembly of FIG. 1 operatively assembled in the receiver of FIG. 11.
Figure 21:
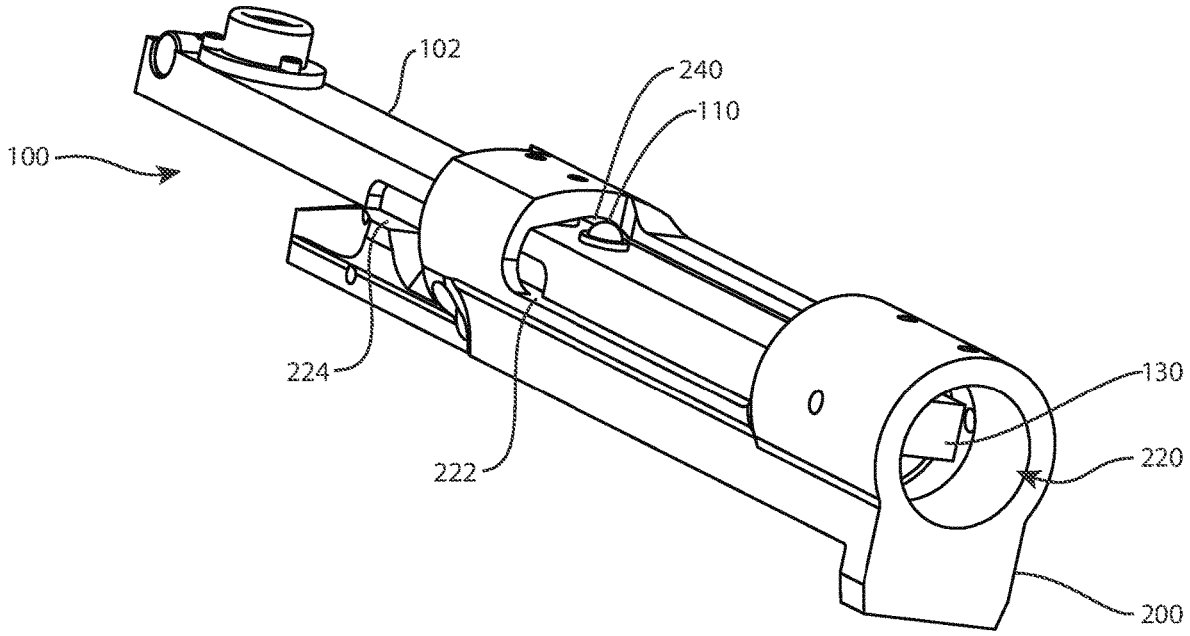
FIG. 21 is a perspective view of the first assembly and receiver of FIG. 20 from a different direction.
Figure 22:
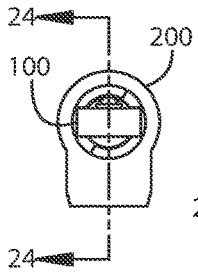
FIG. 22 is a front view of the first assembly and receiver of FIG. 20.
Figure 23:
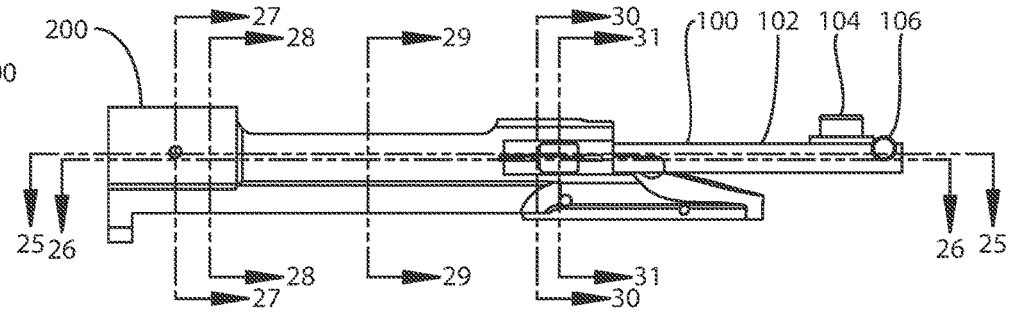
FIG. 23 is a right view of the first assembly and receiver of FIG. 20.

The wall 238 may be referred to as a chamber breech. The right side of the second cylindrical portion 236 may extend rearwardly past the wall 238 to intersect the front right lower planar surface 222 and the front right upper planar surface 228 to form outer edges of the planar surfaces. An upper concave surface 240 extends rearwardly from the second cylindrical portion 236. The upper concave surface 240 may be a section of a cylinder, and may be concentric with the first and second cylindrical portions 234, 236. The diameter of the upper concave surface 240 may be less than the diameter of the second cylindrical portion 236, so that a front-facing wall 242 is formed between the second cylindrical portion and the upper concave surface. The upper concave surface 240 may intersect the upper planar surfaces 228, 230, 232 to form inner edges of the upper planar surfaces. A front lower concave surface 244 extends rearwardly from the second cylindrical portion 236. The front lower concave surface 244 may be a section of the same cylinder as the upper concave surface 240. Thus, the wall 242 may exist between the second cylindrical portion 236 and the front lower concave surface 244. The wall 242 may be the front boundary of the front right upper planar surface 228 and the left lower planar surface 226. The front lower concave surface 244 may intersect the lower planar surfaces 222, 226 to form inner edges of the lower planar surfaces. A longitudinal window 246 extends upwardly into the receiver 200 to intersect the cavity 220 to the rear of the front lower concave surface 244. The window 246 may be referred to as a magazine window or a feed window. A rear lower concave surface 248 extends rearwardly from the window 246. The rear lower concave surface 248 may be a section of the same cylinder as the upper concave surface 240. The rear lower concave surface 248 may intersect the lower planar surfaces 222, 224, 226 to form inner edges of the lower planar surfaces. A longitudinal window 250 extends into the top and right sides of the receiver 200 to intersect the cavity 220. The window 250 may be referred to as an ejection window or ejection port. Referring to FIGS. 17-19, the front end or wall of the window 250 may be slightly in front of the front end or wall of the window 246. The top portion between the front end 210 and the window 250 may be referred to as a front bridge or front arch. The rear end or wall of the window 250 may be slightly in front of the rear end or wall of the window 246. The top portion behind the window 250 may be referred to as a rear bridge or rear arch. A rear right concave surface 252 extends rearwardly from the rear end of the window 250. The rear right concave surface 252 intersects the rear right lower planar surface 224 and the rear right upper planar surface 230 to form outer edges of the planar surfaces. The rear right concave surface 252 may be a section of the same cylinder as the second cylindrical portion 236. A front left concave surface 254 extends rearwardly from the wall 242 past the rear end of the window 246, intersects the left upper planar surface 232 and the left lower planar surface 226 to form outer edges of the planar surfaces, and may be a section of the same cylinder as the first cylindrical portion 234. A window 256 extends into the left side of the receiver 200 to intersect the cavity 220 and form the rear end of the front left concave surface 254. A rear left concave surface 258 extends rearwardly from the window 256, intersects the left upper planar surface 232 and the left lower planar surface 226 to form outer edges of the planar surfaces, and may be a section of the same cylinder as the first cylindrical portion 234.

Referring to FIGS. 20-31, the first assembly 100 may be operatively assembled to the receiver 200 by inserting the front end 130 of the base 102 of the first assembly 100 into the back end of the cavity 220 of the receiver 200 and advancing the first assembly 100 within the cavity 220 so that the bottom side 136 directly contacts at least one, and preferably all, of the lower planar surfaces 222, 224, 226; the top side 134 faces the upper planar surfaces 228, 230, 232; the roller 108 contacts the upper concave surface 240 in front of the window 250; and at least one roller 110, 112 contacts the upper concave surface 240 to the rear of the window 246. The front end 130 of the base 102 may contact the chamber breech, in other words, the wall 238 or the back or breech end of a barrel coupled to the receiver 200.

When the first assembly 100 is operatively assembled to the receiver 200, the bottom side 136 is directly adjacent to the front ends of the lower planar surfaces 222, 226 and the rear ends of the lower planar surfaces 222, 224. The front end of the bottom side 136 is in front of the front end of the window 246, may be in front of the front end of the window 250, and may be in front of the front ends of the lower planar surfaces 222, 226. The rear end of the bottom side 136 is behind the rear end of the window 250, may be behind the rear end of the window 246, and may be behind the rear ends of the lower planar surfaces 222, 224. The right and left sides 138, 140 are directly adjacent to the outer edges of the lower planar surfaces 222, 224, 226. Thus, surface contact between the bottom side 136 and the lower planar datum surface 221 is maximized within the constraint of physically sliding the first assembly 100 into the cavity 220 from the rear. Said another way, the bottom side 136 contacts substantially the full length of the lower planar datum surface 221 measured parallel to the axis 214. From a metrology point of view, there will be at least three points of contact between the bottom side 136 and the lower planar datum surface 221. The three points of contact establish a primary datum plane 260 common to the first assembly 100 and the receiver 200. The primary datum plane 260 may be referred to as a horizontal datum plane. While this description is made in the context of a continuous flat planar bottom side 136, it is contemplated that the bottom side 136 may instead comprise discontinuous patches, or points, for contacting the lower planar datum surface 221. Taken together, the discontinuous patches or points may function as a primary planar datum surface. Whether the bottom side 136 is continuous or discontinuous, the bottom side 136 preferably directly contacts the full length of the lower planar datum surface 221 measured parallel to the axis 214.

In the example shown, when the first assembly 100 is operatively assembled to the receiver 200 as shown in FIGS. 20-31, on an area basis, the bottom side 136 contacts 833 $mm^2$ (43%) of the lower planar datum surface 221, including contacting 379 $mm^2$ (38%) of the front right lower planar surface 222, 26 $mm^2$ (18%) of the rear right lower planar surface 224, and 428 $mm^2$ (53%) of the left lower planar surface 226. It is contemplated that the bottom side 136 may be in direct contact with at least 40% of the area of the lower planar datum surface 221, the front right lower planar surface 222, or the left lower planar surface 226. On a length basis, parallel to the axis 214, the bottom side 136 contacts the full length of the lower planar datum surface 221. However, it is contemplated that the bottom side 136 may contact at least 50% of the length of the lower planar datum surface 221, the front right lower planar surface 222, or the left lower planar surface 226.

When the first assembly 100 is operatively assembled to the receiver 200, the bullseye level 104 and the tube level 106 are behind the back end of the receiver 200. The tube level 104 is oriented with its length, from right to left, perpendicular to the receiver axis 214.

The roller 108 contacts the upper concave surface 240 in front of the window 250. At least one roller 110, 112 contacts the upper concave surface 240 to the rear of the window 246. Two rear rollers 110, 112 are provided to accommodate different size receivers 200. Preferably, the rollers 108, 110, 112 touch intact portions of the upper concave surface 240 away from any holes or other interruptions of the upper concave surface. Preferably, the rollers 108, 110, 112 are compliant, for example biased to extend up from the top side 134 of the base 102. In this arrangement, compliant rollers 108, 110, 112 may deflect downward as they contact the upper concave surface 240. The downward deflection may serve at least two purposes: to automatically accommodate dimensional variations between the upper concave surface 240 and the primary datum plane 260 in individual receivers, and to automatically seek the highest location against the upper concave surface due to the bias which urges the rollers 108, 110, 112 up toward their undeflected state. As the rollers 108, 110, 112 seek the highest location against the upper concave surface 240, the first assembly 100 may be urged right or left within the cavity 220 as a result, thus automatically aligning the first assembly 100 along the interior crest of the upper concave surface 240. From a metrology point of view, each roller will have a point of contact with the upper concave surface 240. Two points of contact establish a secondary datum line 262 along the interior crest of the upper concave surface 240, which establishes a secondary datum plane 264 that contains the secondary datum line 262 and is perpendicular to the primary datum plane 260. The secondary datum plane 264 may be referred to as a vertical datum plane. In the nominal design of the receiver 200, the secondary datum plane 264 may also contain the axis 214. However, it is contemplated that the first assembly 100 may rest asymmetrically within the cavity 220, in other words, offset to the right or left. This may cause the secondary datum plane 264 to be left or right of the axis 214. Alternatively, even if the first assembly 100 rests to the right or left, the rollers 108, 110, 112 may be positioned relative to the base 102 to counteract this eccentricity, so that the secondary datum plane 264 may contain the axis 214.

When the first assembly 100 is operatively assembled to the receiver 200, various parts normally associated with the receiver 200 may remain assembled to the receiver 200 without interfering with the first assembly 100. For example, the trigger assembly and/or ejector may remain assembled to the receiver 200 without pushing on the first assembly 100. Preferably, the magazine well assembly and stock are disassembled from the receiver 200 before the first assembly 100 is operatively assembled to the receiver 200.

Figure 32:
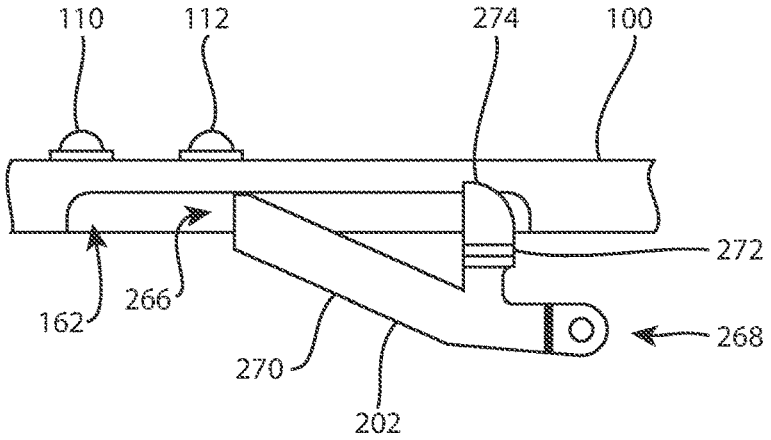
FIG. 32 is a right detail view of a portion of the first assembly of FIG. 1 operatively arranged adjacent to a bolt stop/release.
Figure 33:
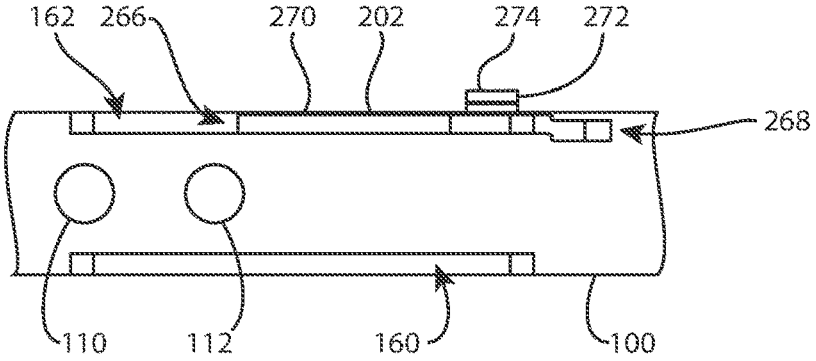
FIG. 33 is a bottom detail view of a portion of the first assembly and bolt stop/release of FIG. 32.

Referring to FIGS. 32-33, side and bottom views show the first assembly 100 operatively arranged adjacent to a bolt stop/release 202 characteristic of a Winchester Model 70 action. The bolt stop/release 202 has a front end 266 and a back end 268. The bolt stop/release 202 may have a thin, flat body 270 that extends between the front and back ends 266, 268. The bolt stop/release 202 may have an upright arm 272 which extends up from the body 270. The arm 272 may jog to the left as it extends up from the body 270, so that an upper portion 274 of the arm is offset, or spaced apart, to the left of the body. The front end of the body 270 is received within the left notch 162 of the base 102 of the first assembly 100 with sufficient clearance so that the bolt stop/release 202 does not push on the first assembly 100. The upper portion 274 of the arm 272 extends up beside the left side 140, outside the notch 162. The left notch 162 may be sized and shaped to also receive the Winchester Model 70 ejector with clearance, or another left notch (not shown) may be provided for this purpose.

Figure 34:
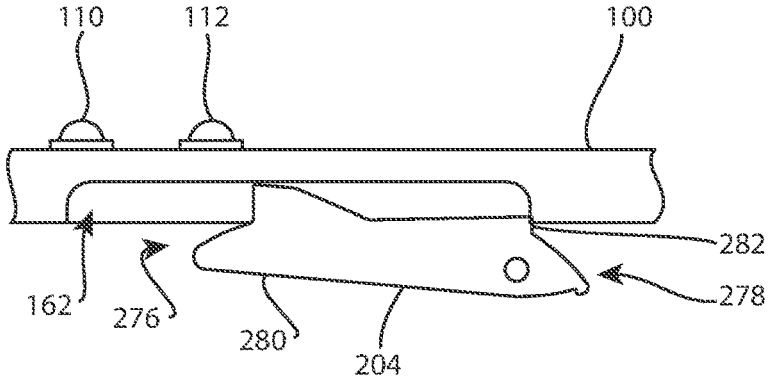
FIG. 34 is a right detail view of a portion of the first assembly of FIG. 1 operatively arranged adjacent to another bolt stop/release.
Figure 35:
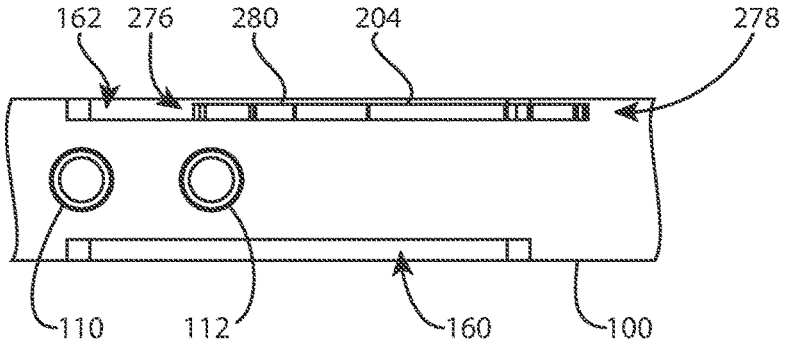
FIG. 35 is a bottom detail view of a portion of the first assembly and bolt stop/release of FIG. 34.

Referring to FIG. 34-35, side and bottom views show the first assembly 100 operatively arranged adjacent to a bolt stop/release 204 characteristic of a Remington 700 action. The bolt stop/release 204 has a front end 276 and a back end 278. The bolt stop/release 204 may have a thin, flat body 280 that extends between the front and back ends 276, 278. The bolt stop/release 204 may have an upper protrusion 282 in a rear portion of the body 280. The front end of the body 280 is received within the left notch 162 of the base 102. The protrusion 282 may also be received within the notch 162. There is sufficient clearance so that the bolt stop/release 204 does not push on the first assembly 100. The left notch 162 may be sized and shaped to also receive the Remington 700 ejector with clearance, or another left notch (not shown) may be provided for this purpose.

FIGS. 32-35 show two examples of bolt stop/releases 202, 204 designed for right-handed shooters. The first assembly 100 is also compatible with bolt stop/releases 202, 204 designed for left-handed shooters, in which case the bolt stop/releases are mirrored about a longitudinal vertical plane (such as plane 264) and received in the right notch 160 of the base 102. Furthermore, various embodiments of the first assembly 100 may be provided with notches that are sized, shaped, and located to correspond to various firearm actions, such as a Borden action or a Defiance action.

Figure 36:
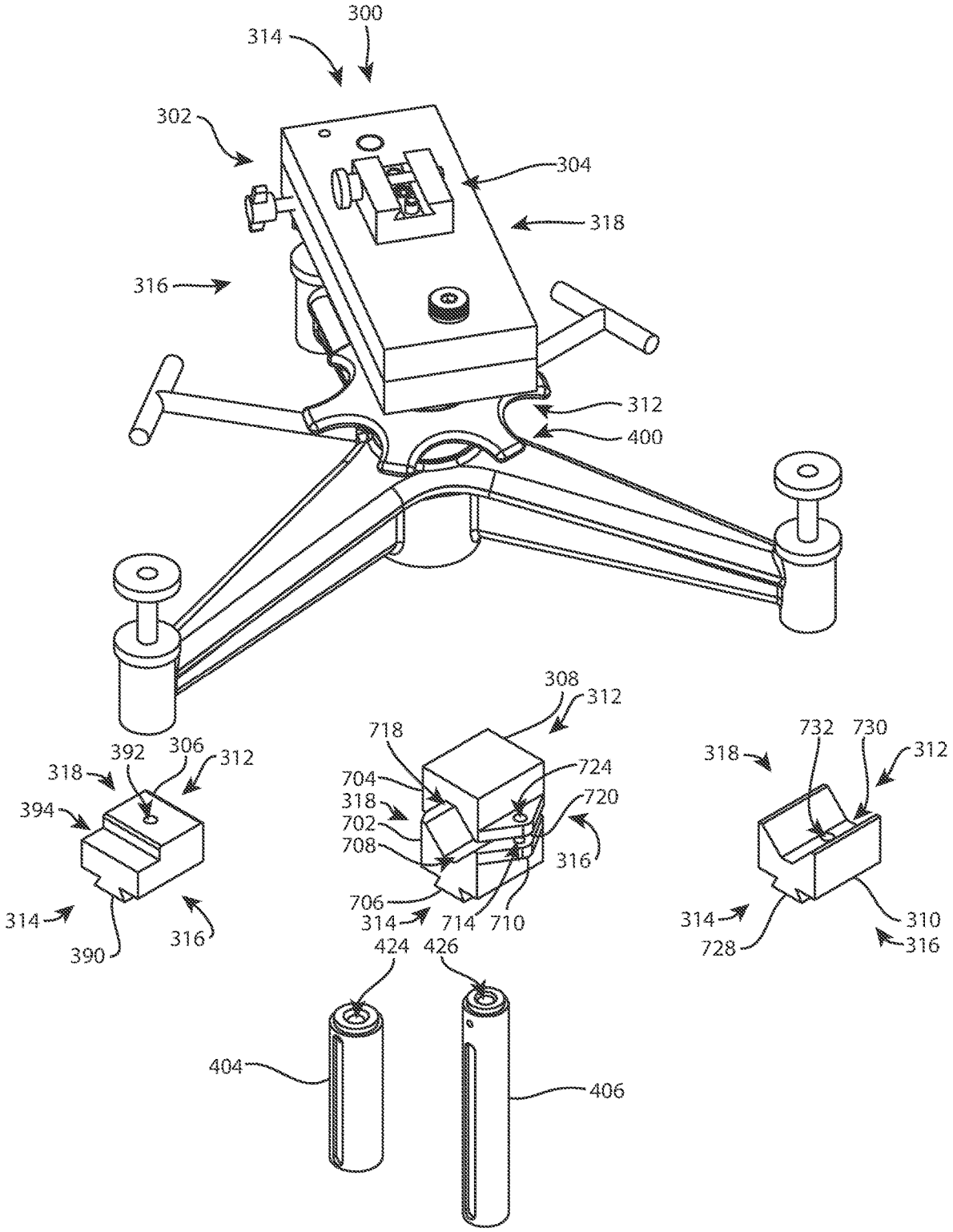
FIG. 36 is a perspective view of a plate sub-assembly of a second assembly operatively assembled to a rifle bench rest, an adapter block base of the second assembly operatively assembled to the plate sub-assembly, three adapter blocks of the second assembly, and two more main columns for interchangeable use in the rifle bench rest, the second assembly also referred to as a sighting holder.
Figure 45:
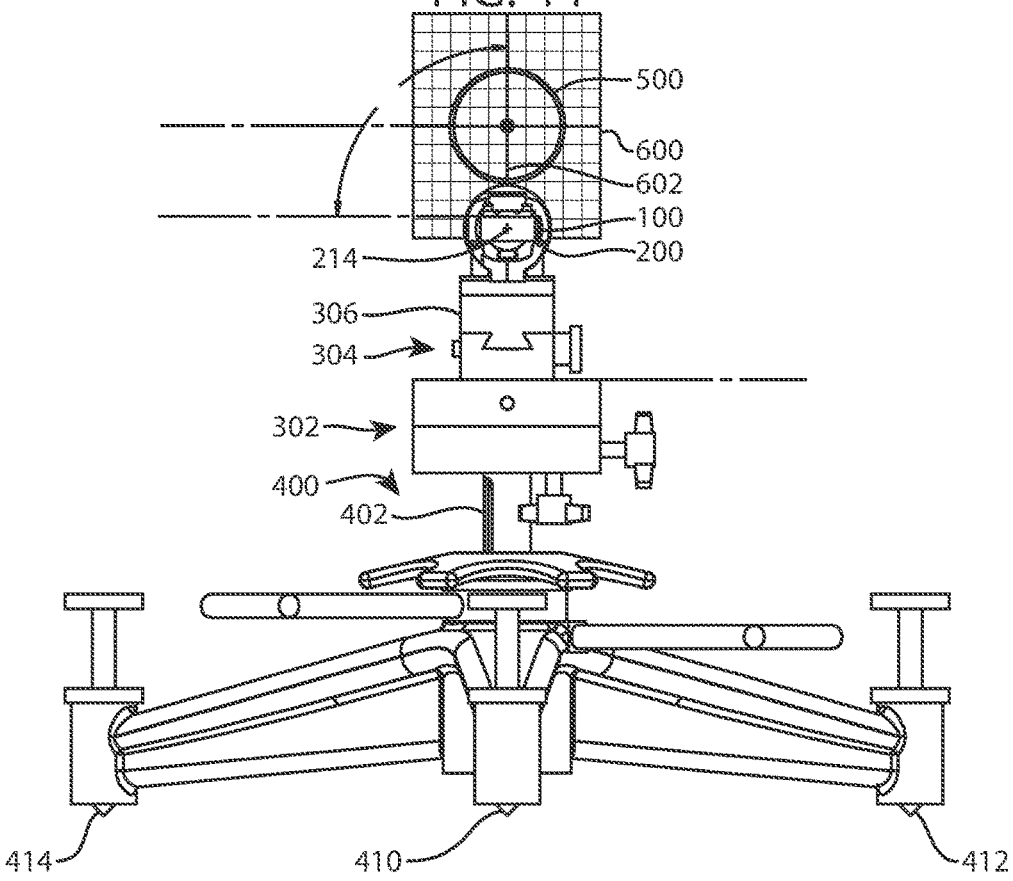
FIG. 45 is a back view of the plate sub-assembly, rifle bench rest, adapter block base, adapter block, first assembly, and receiver of FIG. 42 operatively assembled to a rifle scope, shown schematically.

Referring to FIG. 36, a second assembly 300 may include a plate sub-assembly 302, an adapter block base sub-assembly 304, and/or an adapter block 306. Three adapter blocks 306, 308, 310 are shown for interchangeable connection to the adapter block base 304. Each adapter block 306, 308, 310 is designed to securely couple to a particular style or class of receiver. These are but three examples. Preferably, each adapter block is designed so that the receiver may be secured to its adapter block using the receiver's front guard screw. The second assembly 300 may be referred to as a sighting holder or sighting assembly. The adapter block base sub-assembly 304 is shown operatively assembled to the plate sub-assembly 302, which is operatively assembled to a rifle bench rest 400. Referring briefly to FIG. 45, the plate sub-assembly 302 may be coupled to a main column 402 of the rifle bench rest 400. FIG. 36 also illustrates two more main columns 404, 406 for interchangeable assembly in the rifle bench rest 400. The second assembly 300 has a front end 312, a back end 314, a right side 316, and a left side 318.

Figure 37:
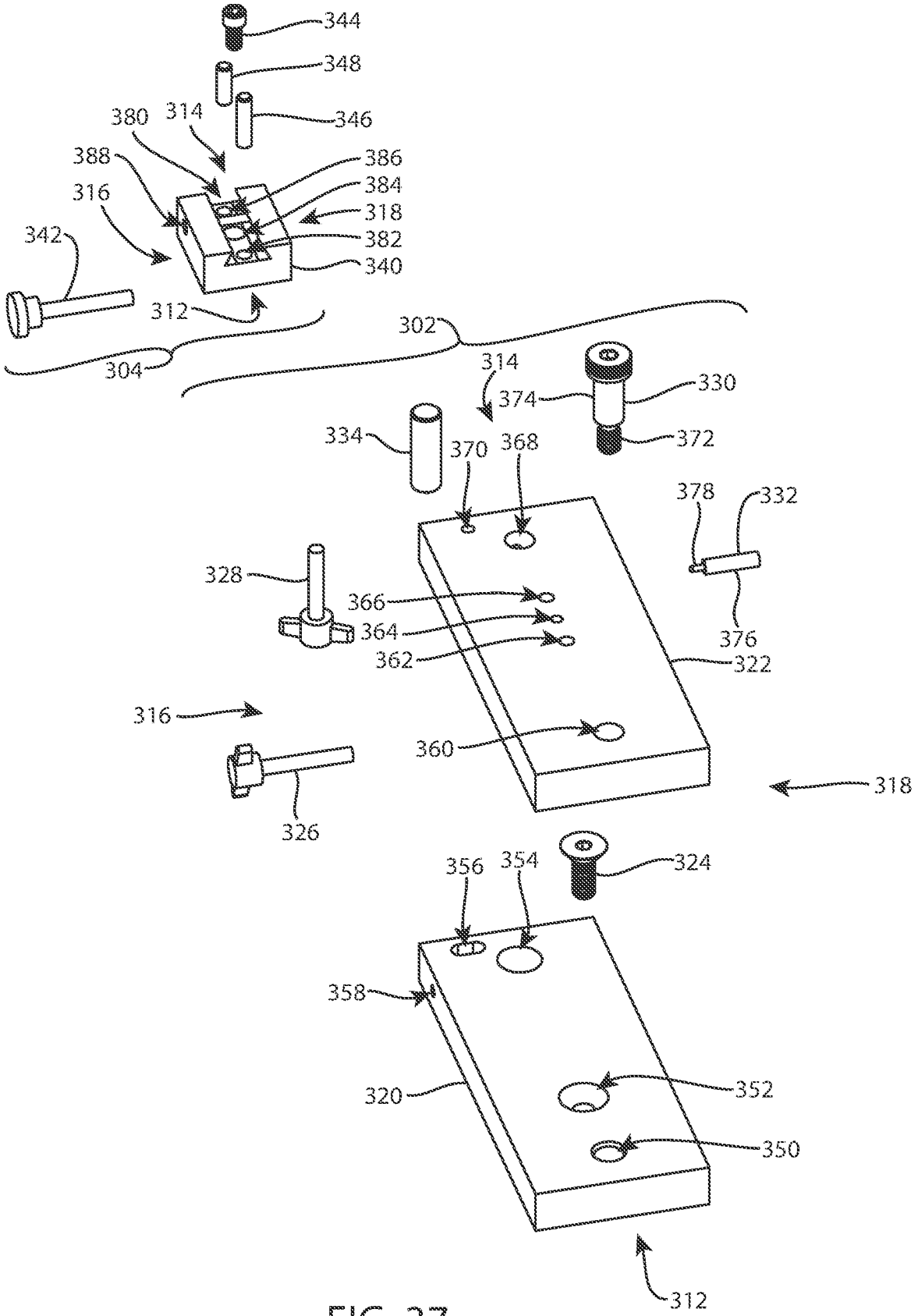
FIG. 37 is an exploded perspective view of the plate sub-assembly and adapter block base of FIG. 36.

Referring to FIG. 37, the plate sub-assembly 302 may include a first plate 320, second plate 322, fasteners 324, 326, 328, 330, spring plunger 332, and pin 334. The first plate 320 may be referred to as a lower plate and the second plate 322 may be referred to as a top plate.

Figure 40:
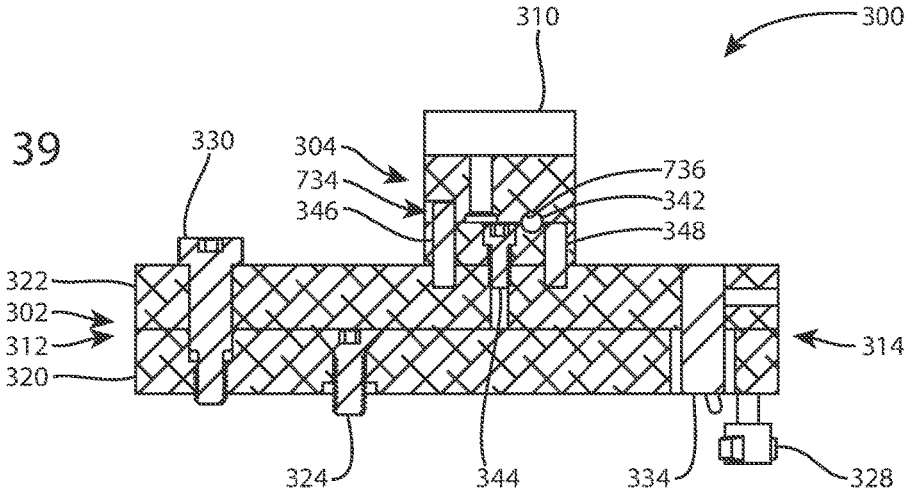
FIG. 40 is a cross-sectional view of the plate sub-assembly, adapter block base, and adapter block of FIG. 39, taken along section line 40-40 of FIG. 39.

The first plate 320 has five holes 350, 352, 354, 356, 358. The holes 350, 352, 354, 356 extend through the first plate 320 along a top-bottom direction. The holes 350, 352, 354 are centrally located between the right and left sides 316, 318 in a linear arrangement from front to back. The holes 350, 352 are in the front half of the first plate 320 and the hole 354 is close to the back end 314. The holes 350, 352 may have internal threads; or hole 352 may be unthreaded (smooth). The top end of the hole 352 may include a countersink. FIG. 40 illustrates that the bottom end of the hole 352 may include a counterbore. The hole 354 may be circular, or elongated along a right-left direction, for example oval. The hole 356 is to the right rear of hole 354. The hole 356 may be elongated along the right-left direction, or circular. The hole 358 extends through the first plate 320 along the right-left direction and intersects the hole 354. The right and/or left portions of hole 358 may have internal threads. The first plate 320 may include an optional bullseye level or tube level (not shown) for preliminary leveling.

The second plate 322 has six holes 360, 362, 364, 366, 368, 370 that extend through the second plate along a top-bottom direction. The holes 360, 362, 364, 366, 368 are centrally located between the right and left sides 316, 318 in a linear arrangement from front to back. The hole 360 is near the front end 312, corresponding to the location of hole 350 of the first plate 320. The holes 362, 364, 366 are grouped in a central region of the second plate 322. The hole 364 may be internally threaded. The hole 368 is near the back end 314, corresponding to the location of hole 354 of the first plate 320. The hole 370 is to the right rear of hole 368, corresponding to the location of hole 356 of the first plate 320. The hole 370 may be internally threaded. The second plate 322 may include an optional hole (not shown) corresponding to the location of hole 352 of the first plate 320, to provide access for a driver to engage the head of the fastener 324 in hole 352 when the plate sub-assembly 302 is operatively assembled. The second plate 322 may include an optional bullseye level or tube level (not shown) for preliminary leveling.

The fastener 324 may be a countersunk head screw.

The fastener 326 may be referred to as a windage adjustment screw. The head of fastener 326 may be adapted for manual tightening and loosening.

The fastener 328 may be referred to as a windage lock screw. The head of fastener 328 may be adapted for manual tightening and loosening.

The fastener 330 may be a socket head shoulder bolt with a threaded tip 372 and a smooth shaft 374 between the tip 372 and the head. The fastener 330 may be referred to as a windage pivot bolt, whose central longitudinal axis may be referred to as a pivot axis.

The spring plunger 332 may have a cylindrical body 376 and a spring-loaded pin tip 378. The body 376 may be smooth or externally threaded.

The plate sub-assembly 302 may be operatively assembled by inserting the fastener 324 through the hole 352 of the first plate 320 from top to bottom with the countersunk head in the countersink and the screw tip protruding from the bottom side of the first plate; positioning the second plate 322 on top of the first plate 320 with the front ends 312 facing the same direction, the right sides 316 facing the same direction, and the top sides facing the same direction; inserting the fastener 330 through the hole 360 from top to bottom and threading the tip 372 into the hole 350; press-fitting the top end of the pin 334 in the hole 368 so that the bottom end of the pin 334 protrudes from the bottom side of the second plate 322 and into the hole 354; inserting the fastener 328 through the hole 356 from bottom to top and threading the tip into the hole 370; inserting the spring plunger 332 into the left portion of the hole 358 so that the tip 378 is against the left side of the pin 334; and threading the fastener 326 into the right portion of the hole 358 so that the tip is against the right side of the pin 334.

Figure 38:
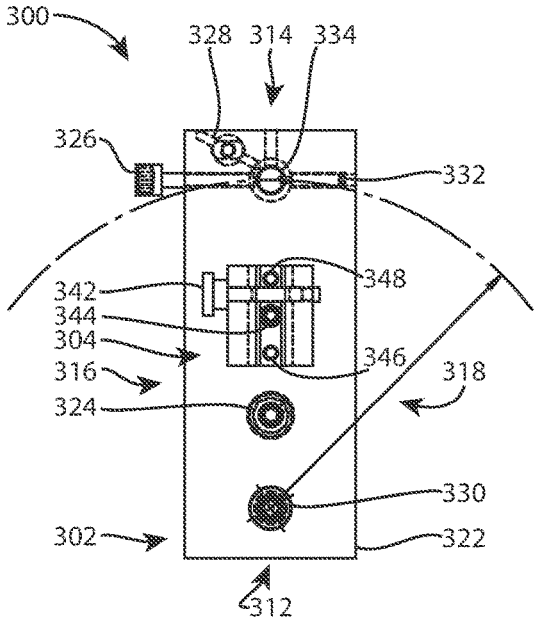
FIG. 38 is a top view of the plate sub-assembly and adapter block base of FIG. 36.

When the plate sub-assembly 302 is operatively assembled, clockwise and counterclockwise rotation of the fastener 326 causes the second plate 322 to rotate, or pivot, relative to the first plate 320 about the fastener 330, against the resistance provided by the spring plunger 332; and clockwise and counterclockwise rotation of the fastener 328 locks and unlocks the rotation of the second plate relative to the first plate. Referring to FIG. 38, the fastener 326, pin 334, and spring plunger 332 function together as a windage fine adjustment mechanism. FIG. 38 illustrates the radius of the arc along which the pin 334 travels as the second plate 322 rotates relative to the first plate 320. The bottom end of the pin 334 may be received in the hole 354 with clearance, which may be provided all around or only along the right-left direction. The plate sub-assembly 302 may include indicia (not shown) to indicate the magnitude of adjustment right or left of a neutral (zero) position. The fastener 328 and pin 334 are centered in the holes 356, 354, respectively, when the plate sub-assembly is in the neutral position. The neutral position is illustrated in FIG. 36. The fastener 328 in hole 356 and/or the pin 334 in hole 354 limit the range of motion or magnitude of windage adjustment provided by the plate sub-assembly 302.

The adapter block base sub-assembly 304 may include a body 340, fasteners 342, 344, and pins 346, 348.

The body 340 includes an undercut channel 380 which extends across the top side between the front and back ends 312, 314. The undercut channel 380 may be a dovetail slot, T-slot, or other undercut geometry. The undercut channel 380 may be open (extend through) the front and/or back ends 312, 314. Three holes 382, 384, 386 extend through the body 340 along a top-bottom direction, centrally located in the right-left width of the undercut channel 380, in a linear arrangement from front to back. The hole 382 is near the front end 312, corresponding to the location of hole 362 of the second plate 322. The hole 384 is near the middle, corresponding to the location of hole 364 of the second plate. The hole 386 is near the back end 314, corresponding to the location of hole 366 of the second plate. The hole 384 may be internally threaded or non-threaded (smooth). The top end of the hole 384 may include a counterbore (FIG. 40). A hole 388 extends through the body 340 along a right-left direction and intersects the undercut channel 380 between the holes 384, 386. The right and/or left portions of hole 388 may be internally threaded.

The fastener 342 may be referred to as a cross screw. The head of the fastener 342 may be adapted for manual tightening or loosening.

The fastener 344 may be a socket head cap screw.

The adapter block base sub-assembly 304 may be operatively assembled by fixing the pin 346 in the hole 382 so that the bottom end of the pin 346 protrudes below the bottom side of the body 340 and the top end of the pin 346 protrudes up into the undercut channel 380 (see FIGS. 36, 39, and 40); inserting the fastener 344 into the hole 384 from top to bottom so that the head is received in the counterbore and the tip protrudes below the bottom side of the body 340; fixing the pin 348 in the hole 386 so that the bottom end of the pin 348 protrudes below the bottom side of the body 340 and the top end of the pin 348 is even with or recessed below the undercut channel 380 (see FIG. 40); and inserting the fastener 342 into the hole 388 so that the tip protrudes from the opposite side of the body 340 from the head (see FIGS. 38 and 39). The fastener 342 is illustrated with the head against the right side 316 and the tip protruding from the left side 318.

When the adapter block base sub-assembly 304 is operatively assembled, the fastener 342 may be inserted into and removed from the hole 388 by a user. One or more of the fasteners 342, 344 and pins 346, 348 may be captive to the body 340.

The plate sub-assembly 302 and the adapter block base sub-assembly 304 may be operatively assembled by inserting the bottom end of pin 346 into the hole 362; inserting the tip of the fastener 344 into the hole 364, for example by threading the fastener 344 into the hole 364; and inserting the bottom end of pin 348 into the hole 366. The pin 346 and holes 382, 362 may be a different diameter than the pin 348 and holes 386, 366; or the bottom end of pin 346 may protrude below the bottom side of the body 340 a different distance than the bottom end of pin 348; so that the plate sub-assembly 302 and the adapter block base sub-assembly 304 may only be assembled in a single orientation with the front ends 312 facing the same direction, the right sides 316 facing the same direction, and the top sides facing the same direction.

When the plate sub-assembly 302 and the adapter block base sub-assembly 304 are operatively assembled, the second plate 322 and the body 340 are rigidly secured together and mutually aligned along a front-back line extending through the holes 362, 364, 366, 382, 384, 386.

Returning to FIG. 36, the adapter block 306 may be adapted to couple to the illustrated receiver 200. The adapter block 306 includes an undercut rail 390 which extends across the bottom side between the front and back ends 312, 314. The undercut rail 390 may be a dovetail rail, T-rail, or other undercut geometry, and is preferably complementary to the undercut channel 380 of the body 340 of the adapter block base sub-assembly 304. The undercut rail 390 may extend across the entire bottom side, or a portion. A hole 392 may extend through the adapter block 306 along a top-bottom direction and may be located in a front half of the adapter block 306. The hole 392 may be internally threaded to correspond to the external threads of the front guard screw for the receiver 200. A notch 394 may extend across the top back end of the adapter block 306 along a right-left direction to form a step down from the top side. The notch 394 may have a 90 degree internal corner.

The adapter block assembly 308 may be adapted to couple directly to a scope 500, without the first assembly 100 or receiver 200. Preferably, the adapter block assembly 308 may couple to a 1", 30 mm, or 34 mm scope. The adapter block assembly 308 may include a bottom block 702 and a top block 704. Optional fasteners (not shown) may be included with the adapter block assembly 308. This enables a shooter to test whether the scope 500 by itself has accurate come up adjustment or elevation adjustment, which may be of interest in military or other specialized shooting situations.

Figure 49:
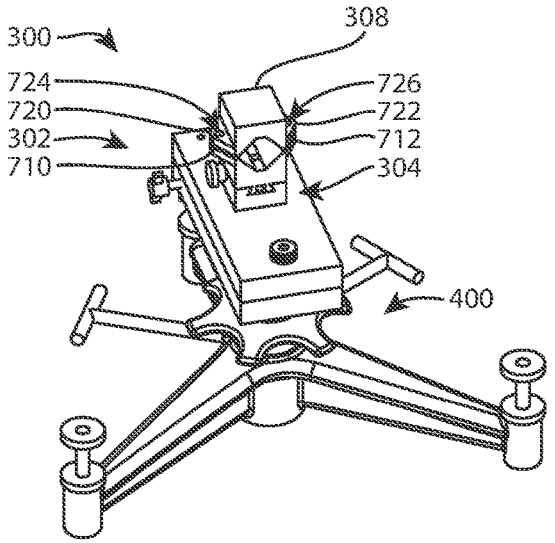
FIG. 49 is a perspective view of the plate sub-assembly, rifle bench rest, and adapter block base of FIG. 36, with yet another one of the adapter blocks of FIG. 36 operatively assembled to the adapter block base.

The bottom block 702 includes an undercut rail 706 which extends across the bottom side between the front and back ends 312, 314. The undercut rail 706 may be a dovetail rail, T-rail, or other undercut geometry, and is preferably complementary to the undercut channel 380 of the body 340 of the adapter block base sub-assembly 304. The undercut rail 706 may extend across the entire bottom side, or a portion. A V-groove 708 extends across the top side between the front and back ends 312, 314. A tab 710, or ear, may protrude from the top right side of the bottom block 702; a mirror image tab 712 may protrude from the top left side of the bottom block 702 (FIG. 49). A hole 714 may extend through the tab 710 along a top-bottom direction and may include internal threads; an identical hole (not visible) may extend through the tab 712.

The top block 704 includes a V-groove 718 that extends across the bottom side between the front and back ends 312, 314. A tab 720, or ear, may protrude from the bottom right side of the top block 704; a mirror image tab 722 may protrude from the bottom left side of the top block 704 (FIG. 49). A hole 724 may extend through the tab 720 along a top-bottom direction and may include internal threads or may be smooth; an identical hole 726 (FIG. 49) may extend through the tab 722.

The adapter block assembly 308 may be operatively assembled by orienting the bottom and top blocks 702, 704 with the front ends 312 facing the same direction, the right sides 316 facing the same direction, and the top sides facing the same direction, so that the V-grooves 708, 718 face each other, the tabs 710, 720 face each other, and the tabs 712, 722 face each other. Fasteners (not shown), such as screws, may be inserted through the holes in the tabs to lock the bottom and top blocks 702, 704 together.

The adapter block 310 may be adapted to couple to a standard Remington 700 or round clone receiver. The round receiver is held rigidly in the V block 310 so that the action will not roll right or left as the scope is being leveled, as discussed below. The adapter block 310 includes an undercut rail 728 which extends across the bottom side between the front and back ends 312, 314. The undercut rail 728 may be a dovetail rail, T-rail, or other undercut geometry, and is preferably complementary to the undercut channel 380 of the body 340 of the adapter block base sub-assembly 304. The undercut rail 728 may extend across the entire bottom side, or a portion. A V-groove 730 extends across the top side between the front and back ends 312, 314. A hole 732 may extend through the adapter block 310 along a top-bottom direction and may be located in a front half of the adapter block 310. The hole 732 may be internally threaded to correspond to the external threads of the front guard screw for the standard Remington 700 or round clone receiver. Other action blocks are contemplated for various actions, each including a hole to receive the corresponding front guard screw. Referring to FIG. 40, a notch 734 may extend into the bottom front end of the adapter block 310. The notch 734 may be sized, shaped, and located to receive the top end of the pin 346. A transverse groove 736 may extend across the bottom side of the adapter block 310 between the right and left sides 316, 318 in the rear half of the adapter block. The groove 736 may be sized, shaped, and located to receive a portion of the fastener 342.

Figure 39:
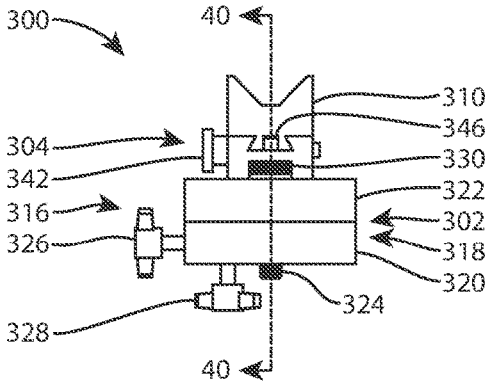
FIG. 39 is a front view of the plate sub-assembly and adapter block base of FIG. 38, with one of the adapter blocks of FIG. 36 operatively assembled to the adapter block base.

Referring to FIGS. 39-40, each adapter block may be interchangeably operatively assembled to the adapter block base sub-assembly 304. The adapter block 310 is shown as an example. The adapter block 310 may be operatively assembled to the adapter block base sub-assembly 304 by sliding the front end of the undercut rail 728 into the back end of the undercut channel 380 of the body 340 of the adapter block base sub-assembly 304 until the top end of the pin 346 enters the notch 734 and inserting the fastener 342 through the hole 388 and the groove 736.

When the adapter block 310 is operatively assembled to the adapter block base sub-assembly 304, the adapter block 310 is rigidly secured to the adapter block base sub-assembly and aligned along a front-back line extending through the holes 382, 384, 386.

Figure 51:
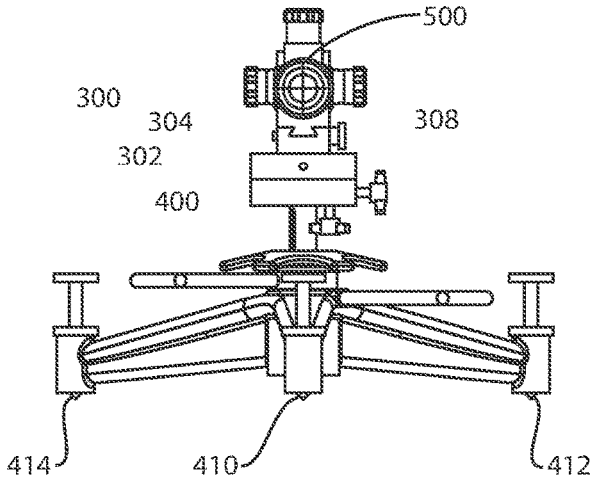
FIG. 51 is a back view of the plate sub-assembly, rifle bench rest, adapter block base, adapter block, and rifle scope of FIG. 50.

Returning to FIG. 36, the rifle bench rest 400 may be a prior art apparatus such as those marketed by Sinclair, Hart, and Wichita. Not every part or feature of the rifle bench rest 400 will be described. The rifle bench rest 400 may include a main column 402 (FIG. 45) and three adjustable feet 410, 412, 414 (FIG. 51). The main column 402 may be replaced by the main column 404 or the main column 406. The top end of each main column 402, 404, 406 may include an internally threaded hole 422 (not visible), 424, 426. Each foot 410, 412, 414 is adjustable up and down to raise or lower the foot as needed to make the main column precisely vertical or achieve other alignment goals.

Figure 41:
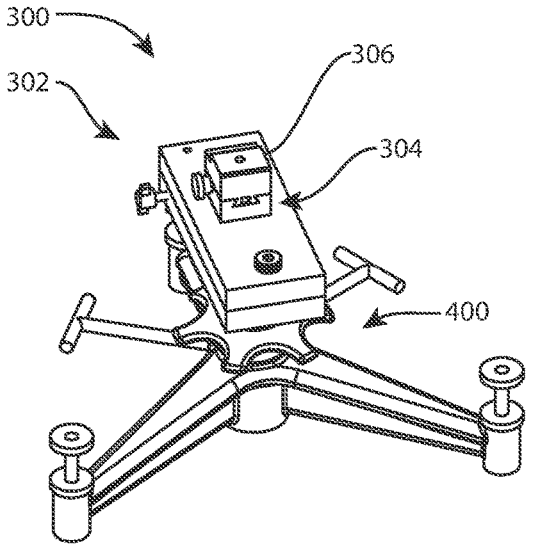
FIG. 41 is a perspective view of the plate sub-assembly, rifle bench rest, and adapter block base of FIG. 36, with another one of the adapter blocks of FIG. 36 operatively assembled to the adapter block base.

Referring to FIG. 41, the adapter block 306, adapter block base sub-assembly 304, plate sub-assembly 302, and rifle bench rest 400 are shown operatively assembled together.

Figure 42:
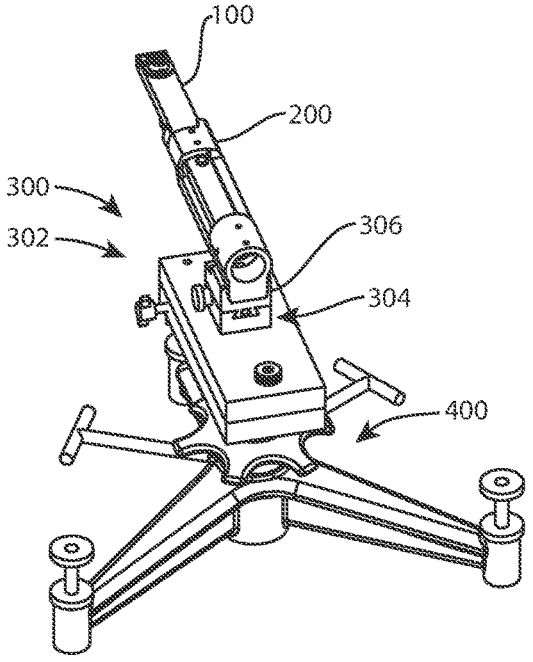
FIG. 42 is a perspective view of the plate sub-assembly, rifle bench rest, adapter block base, and adapter block of FIG. 41 operatively assembled to the first assembly and receiver of FIG. 20.
Figure 43:
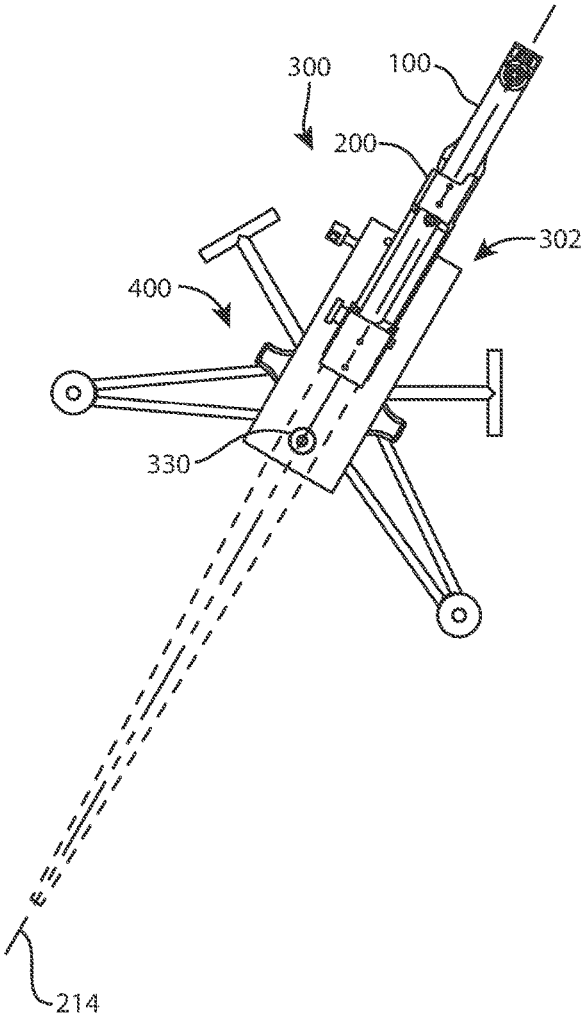
FIG. 43 is a top view of the plate sub-assembly, rifle bench rest, adapter block base, adapter block, first assembly, and receiver of FIG. 42.

Referring to FIGS. 42 and 43, the receiver 200 may be operatively assembled to the adapter block 306 by placing the bottom surface 216 of the receiver 200 against the top side of the adapter block 306 with the front ends 210, 312 facing the same way and inserting the front guard screw for the receiver 200 through the hole 392 and into the hole 218. The receiver 200 and adapter block 306 may then be operatively assembled to the adapter block base sub-assembly 304. The adapter block base sub-assembly 304, plate sub-assembly 302, and rifle bench rest 400 may already be operatively assembled together. FIG. 43 shows that the fastener 330 is preferably centered under the receiver axis 214 so that the axis 214 intersects the pivot axis of the fastener 330. FIG. 45 shows that the foot 410 of the rifle bench rest 400 is preferably centered under the receiver axis 214. The first assembly 100 may be operatively assembled to the receiver 200 at any step in this procedure, preferably after the receiver 200, adapter block 306, adapter block base sub-assembly 304, plate sub-assembly 302, and rifle bench rest 400 have been assembled. FIG. 43 shows a barrel, in dashed lines, coupled to the receiver 200. While not shown for clarity, the trigger assembly, ejector, and/or other assemblies and parts normally coupled to the receiver 200 may remain attached. However, preferably, the magazine well assembly and stock are removed.

Similarly, the standard Remington 700 or round clone receiver may be operatively assembled to the adapter block 310 by placing the bottom side of the action in the V-groove 730 with the front ends facing the same way and inserting the front guard screw for the action through the hole 732 and into the front guard screw hole of the action.

Figure 44:
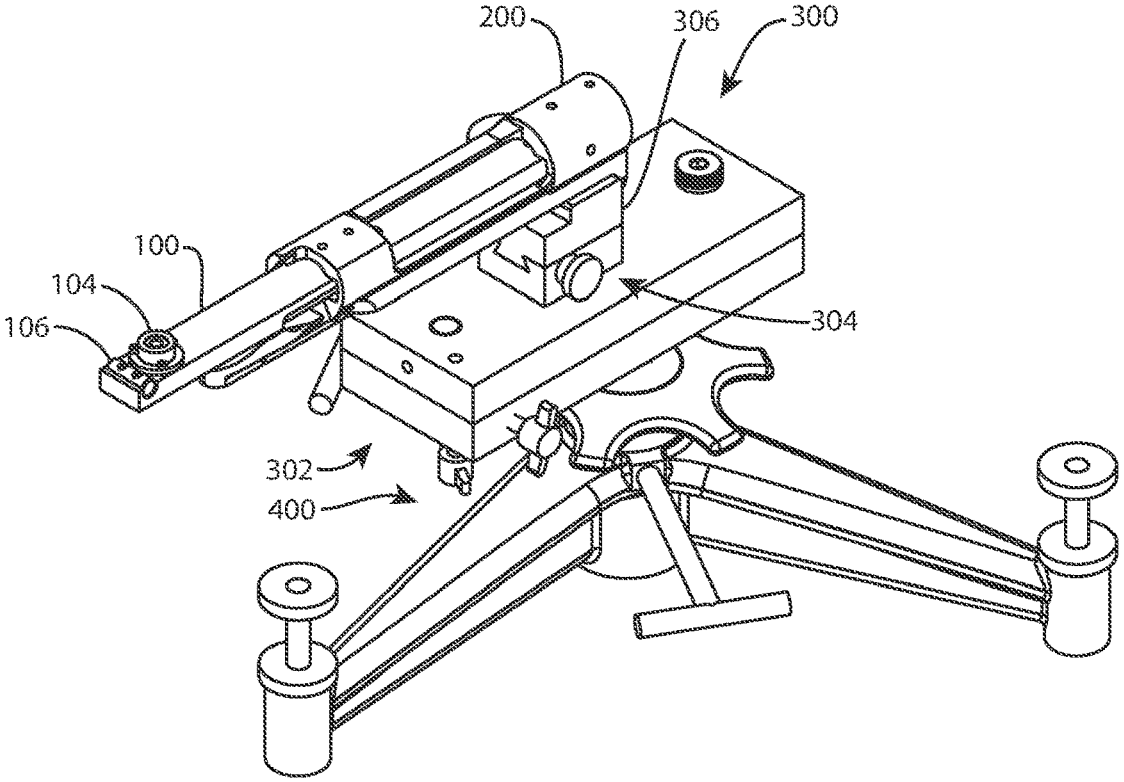
FIG. 44 is another perspective view of the plate sub-assembly, rifle bench rest, adapter block base, adapter block, first assembly, and receiver of FIG. 42 from a different direction.

Referring to FIG. 44, after the first assembly 100, receiver 200, adapter block 306, adapter block base sub-assembly 304, plate sub-assembly 302, and rifle bench rest 400 have been assembled, the combined apparatus may be positioned with the receiver 200 visually aimed downrange. The feet 410, 412, 414 of the rifle bench rest 400 may be adjusted up or down until the bubble in the tube level 106 of the first assembly 100 is centered. The feet 410, 412, 414 may also be adjusted until the bubble in the bullseye level 104 is centered. When the bubbles in the tube level 106 and/or the bullseye level 104 are precisely centered, the receiver 200 and its axis 214 are precisely leveled with respect to Earth's gravity. Preferably, the feet 410, 412, 414 are adjusted until the bubbles in the tube level 106 and the bullseye level 104 are simultaneously precisely centered.

Referring to FIG. 45, a scope 500 may be coupled to the precisely leveled receiver 200. The scope 500 is shown schematically in this figure. The scope 500 may be coupled to the receiver 200 before the receiver has been precisely leveled. Either way, at this stage, the scope 500 is preferably coupled to the receiver 200 loosely enough that the scope may be reoriented relative to the receiver. A target 600 may be mounted to a target frame (not shown) and set up downrange, for example, at 100 yards, 200 yards, 500 yards, 1000 yards, etc. Preferably, the target 600 may be mounted to the frame with reference to a plumb line or other true vertical datum (not shown) so that vertical indicia 602 on the target 600 are precisely vertical. A plumb line may be used instead of the target 600.

Elevation at the downrange target 600 may be adjusted at foot 410, which is preferably in the rear and centered under the central longitudinal axis 214 of the receiver 200. As the vertical reticle image can span about 48" at 100 yards or meters, and the height of the target image downrange can also vary, the rear post adjustment screw (foot 410) is a practical means for elevation adjustment. Elevation may be adjusted while viewing the target 600 through the scope 500. Preferably, elevation is adjusted so that the horizontal reticle is even with the center point of the target.

Windage at the target 600 may be adjusted using the plate sub-assembly 302, preferably without repositioning the rifle bench rest 400, preferably without repositioning the feet 410, 412, 414. Fastener 326 may be turned clockwise and counterclockwise to adjust windage while viewing the target 600 through the scope 500. Preferably, windage is adjusted so that the vertical reticle is even with the center point of the target. At this stage, the vertical and horizontal reticles may not be truly vertical and horizontal, but their intersection is superimposed over the o center point of the target. Fastener 328 may be tightened to lock the plate sub-assembly 302 when windage is precisely adjusted, or loosened to permit further windage adjustment. The illustrated plate sub-assembly 302 provides over 18" of right to left horizontal adjustment or correction at 100 yards or meters.

The scope 500 may be rotated right or left to align its vertical reticle to a vertical datum at the target 600, such as a plumb line, a 4 foot sheet rock level, a commercial target, a laser generated line, or a target having two closely-spaced vertical indicia 602. The scope 500 may be rotated while viewing the target 600 through the scope. Preferably, the receiver 200 remains precisely leveled while the scope 500 is rotated. After the vertical reticle is precisely aligned to the vertical datum at the target 600, the scope 500 may be tightly secured to the receiver 200. This may involve multiple iterations of incrementally tightening the scope fittings, checking the alignment of the vertical reticle by viewing the vertical datum through the scope, checking the levels 104, 106, and rotating the scope to realign the vertical reticle to the vertical datum.

While the preceding steps of elevation adjustment, windage adjustment, and scope rotation are described in an order, the steps may be performed in any order and any step may be performed more than once during scope alignment.

After the scope has been aligned and tightly secured to the receiver 200, a scope level (not shown) may be attached, aligned so that its bubble is centered, and fixed to the aligned scope 500. Performing this step at this stage may ensure that the scope level is actually "true," i.e., the scope level bubble is centered when the scope 500 and receiver 200 are truly level. The scope level may then be relied upon in the field when aiming in on a target.

Figure 46:
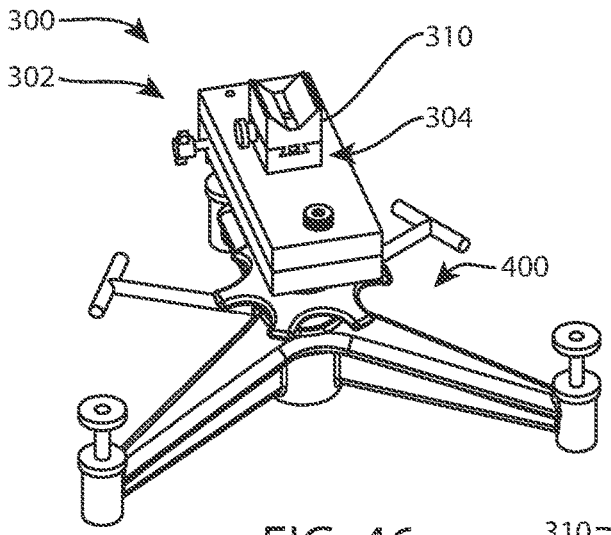
FIG. 46 is a perspective view of the plate sub-assembly, adapter block base, and adapter block of FIG. 38 operatively assembled to the rifle bench rest of FIG. 36.
Figure 47:
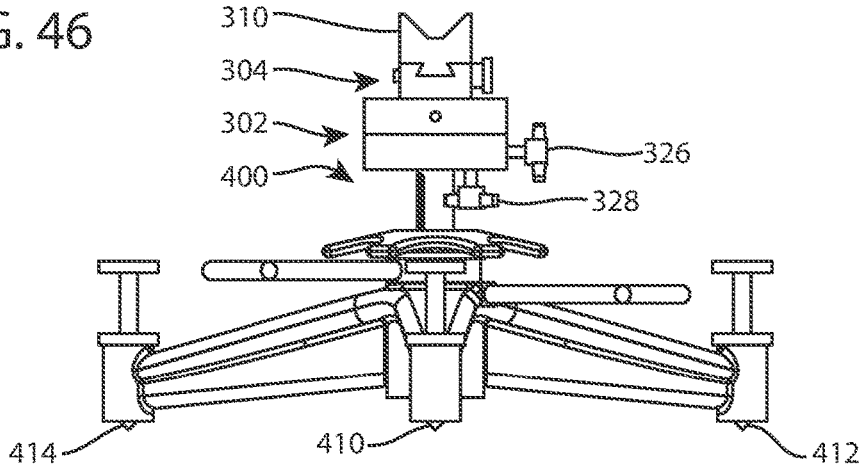
FIG. 47 is a back view of the plate sub-assembly, adapter block base, adapter block, and rifle bench rest of FIG. 46.
Figure 48:
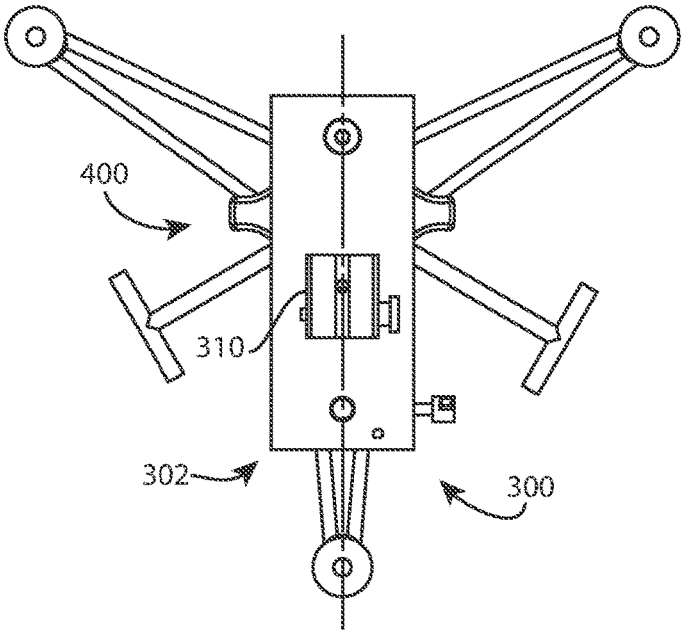
FIG. 48 is a top view of the plate sub-assembly, adapter block base, adapter block, and rifle bench rest of FIG. 46.

Referring to FIGS. 46-48, the adapter block 310, adapter block base sub-assembly 304, plate sub-assembly 302, and rifle bench rest 400 are shown operatively assembled together.

Referring to FIG. 49, the adapter block assembly 308, adapter block base sub-assembly 304, plate sub-assembly 302, and rifle bench rest 400 are shown operatively assembled together.

Figure 50:
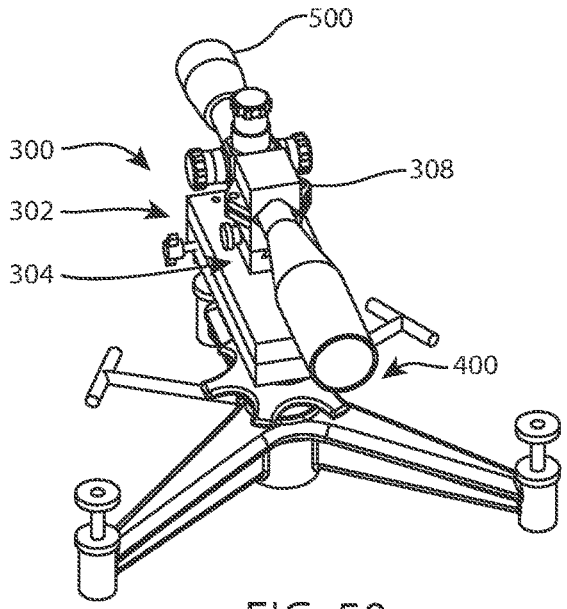
FIG. 50 is a perspective view of the plate sub-assembly, rifle bench rest, adapter block base, and adapter block of FIG. 49, with a rifle scope operatively assembled to the adapter block.
Figure 52:
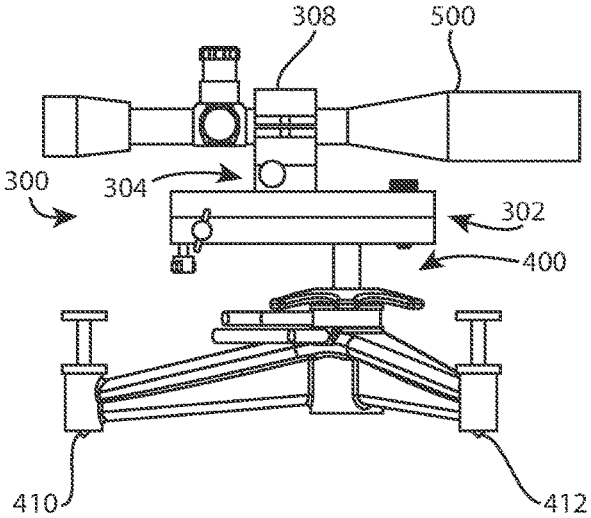
FIG. 52 is a side view of the plate sub-assembly, rifle bench rest, adapter block base, adapter block, and rifle scope of FIG. 50.

Referring to FIGS. 50-52, the scope 500 is shown operatively assembled in the adapter block assembly 308. This arrangement enables a scope to be evaluated for accurate movement in response to scope turret actuation. In other words, this arrangement tests a scope for accurate elevation (come up) and/or windage adjustment.

Figure 53:
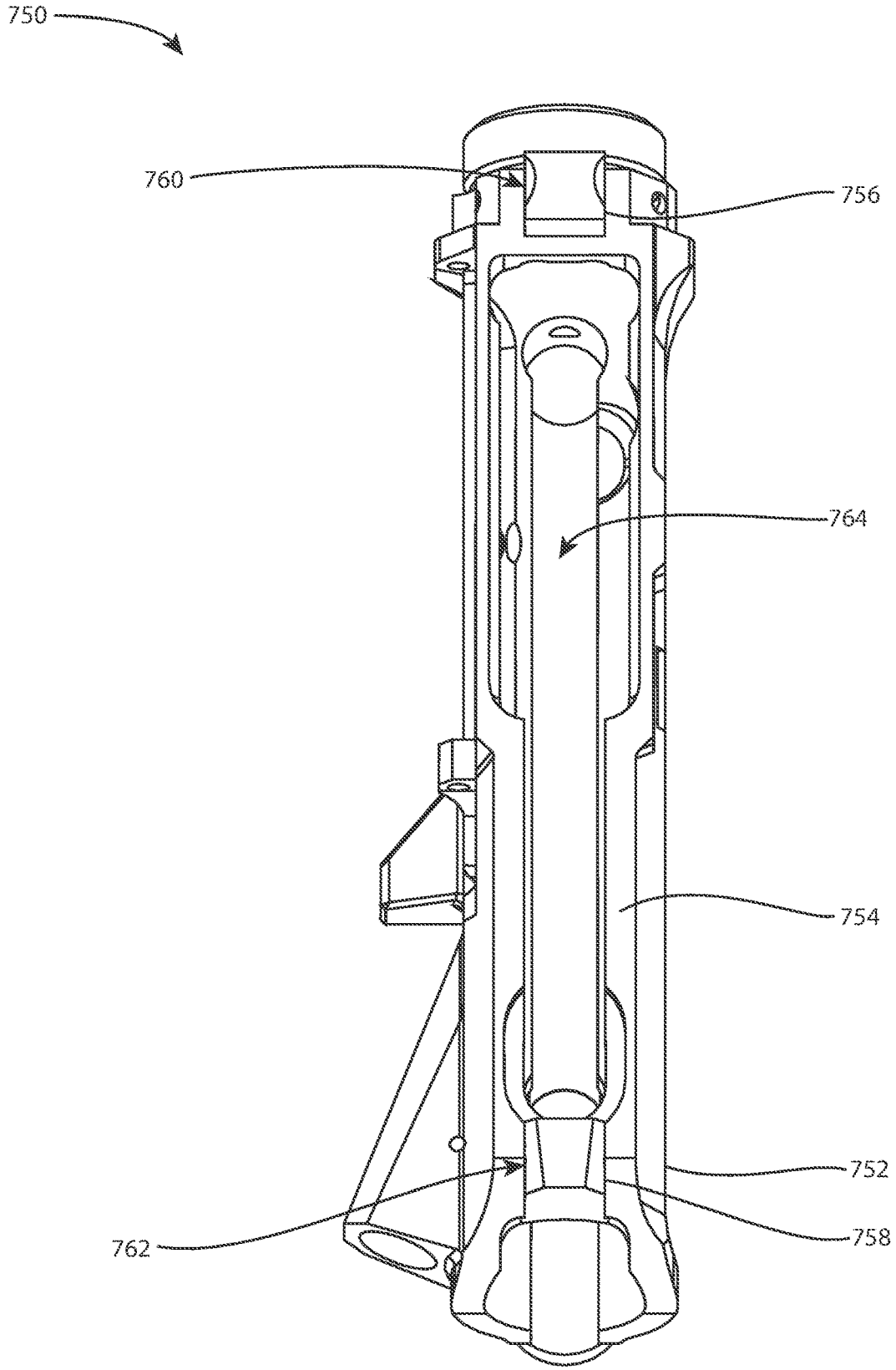
FIG. 53 is a bottom view of an AR action.

Referring to FIG. 53, a bottom side of an AR action 750 is shown. The AR action includes a receiver 752 having a planar bottom surface 754, a front takedown boss 756, a rear takedown boss 758, and a chamber 764. The bottom surface 754, particularly between the front and rear takedown bosses 756, 758, is a reliable precision machined planar surface which is an excellent primary datum feature for the disclosed technology. The bottom surface 754 between the front and rear takedown bosses 756, 758 may be referred to as a planar datum surface. The front takedown boss 756 includes a front takedown hole 760 and the rear takedown boss 758 includes a rear takedown hole 762. The chamber 764 is a cavity which extends into the receiver 752 from the bottom side. The AR action also includes a rear takedown pin 766, visible in FIG. 54. Many variants now exist based upon the original ArmaLite design: AR-10, AR-15, M1, M4, M16, etc. In 2009, the term "modern sporting rifle" was coined by the National Shooting Sports Foundation to describe modular semi-automatic rifles including AR-15s. Today, nearly every major firearm manufacturer produces its own generic AR-15 style rifle.

Referring to FIGS. 54-61, the AR action 750 is shown coupled to a scope 770. A third assembly 800 may be an adaptation of the principles disclosed above for the first and second assemblies 100, 300, specific to the AR action 750. The third assembly 800 may thus be referred to as an AR sighting holder or AR sighting assembly. The third assembly 800 may include an adapter block 802 which functions like the adapter blocks 306, 308, 310 to securely couple to the AR receiver 752, and a plate sub-assembly 804 which functions like the plate sub-assembly 302. The third assembly 800 is shown coupled to the rifle bench rest 400.

Figure 56:
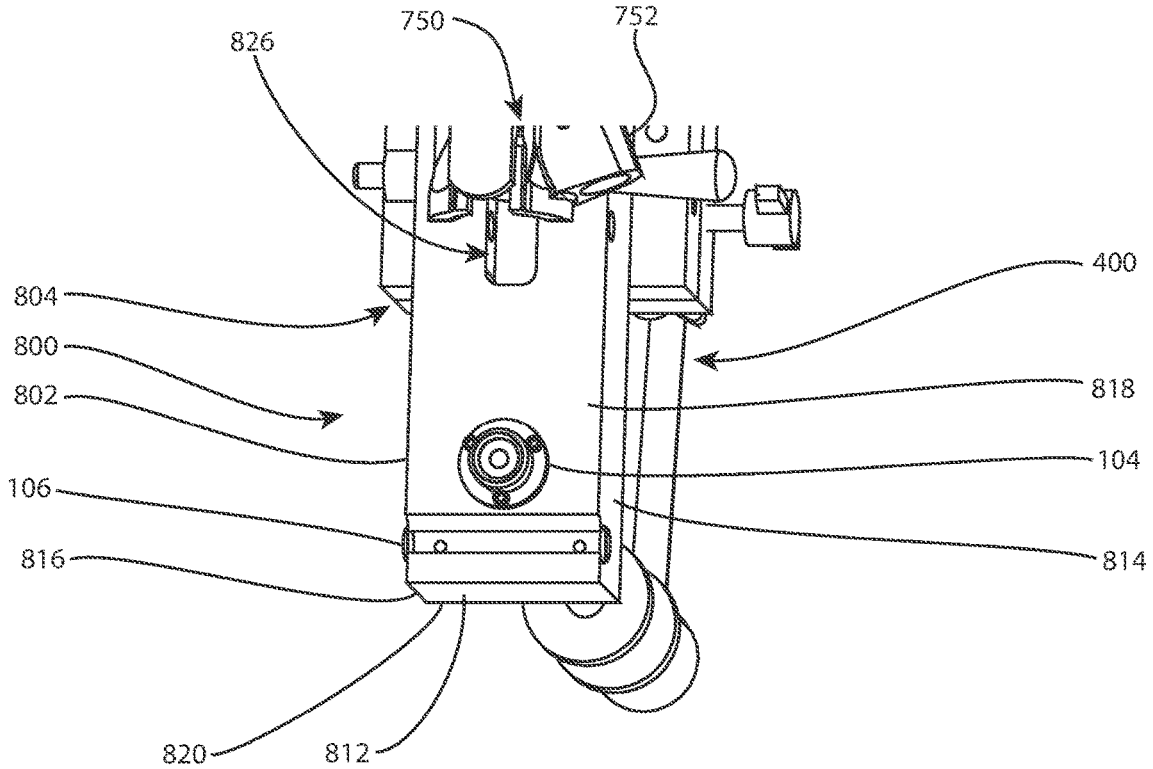
FIG. 56 is an oblique detail view of a portion of the AR action, third assembly, and rifle bench rest of FIG. 54.
Figure 57:
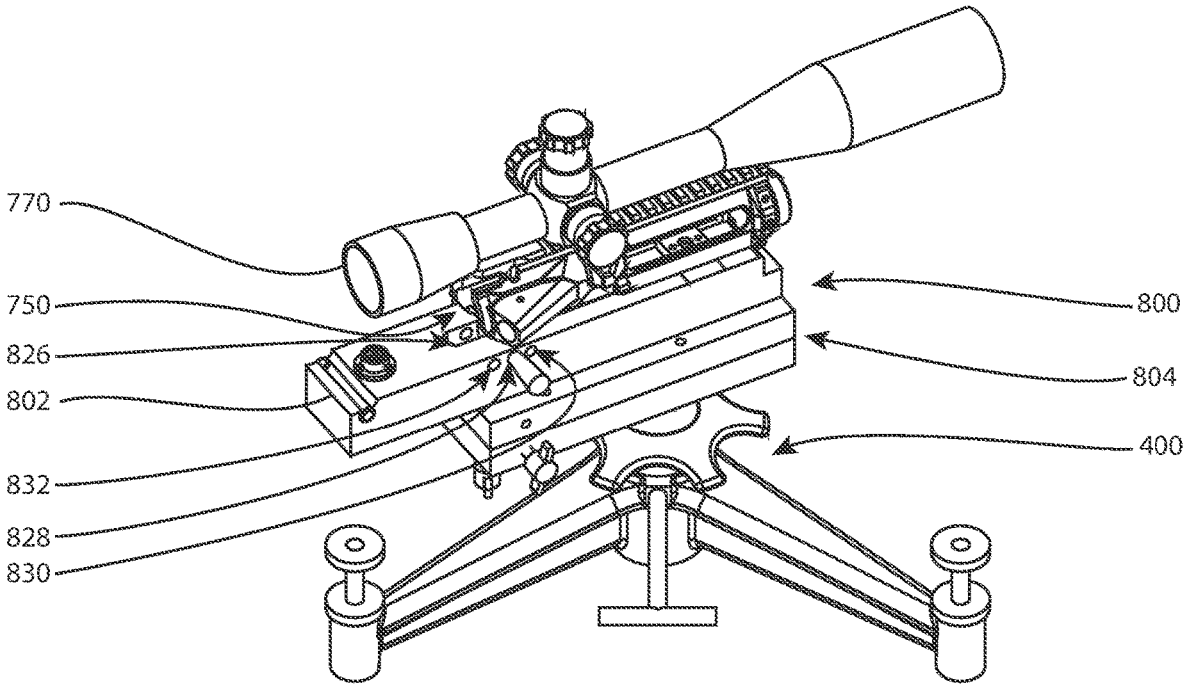
FIG. 57 is an oblique view of the AR action, scope, third assembly, and rifle bench rest of FIG. 54, the AR action fully coupled to the third assembly.
Figure 58:
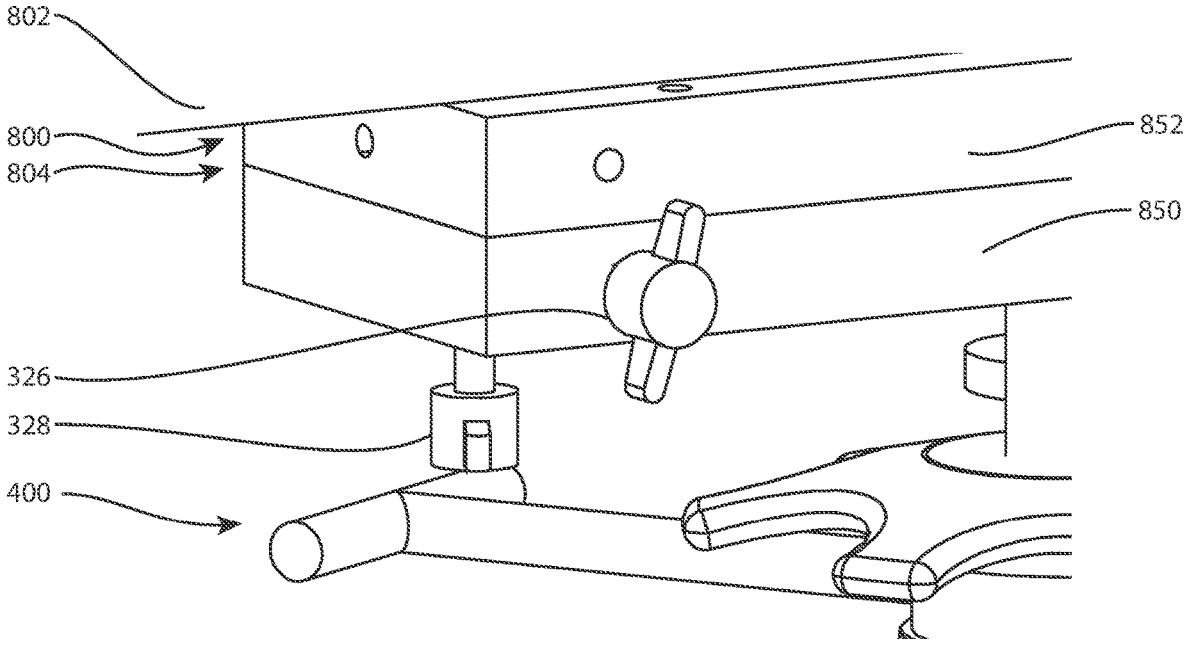
FIG. 58 is an oblique detail view of a portion of the third assembly and rifle bench rest of FIG. 54.
Figure 59:
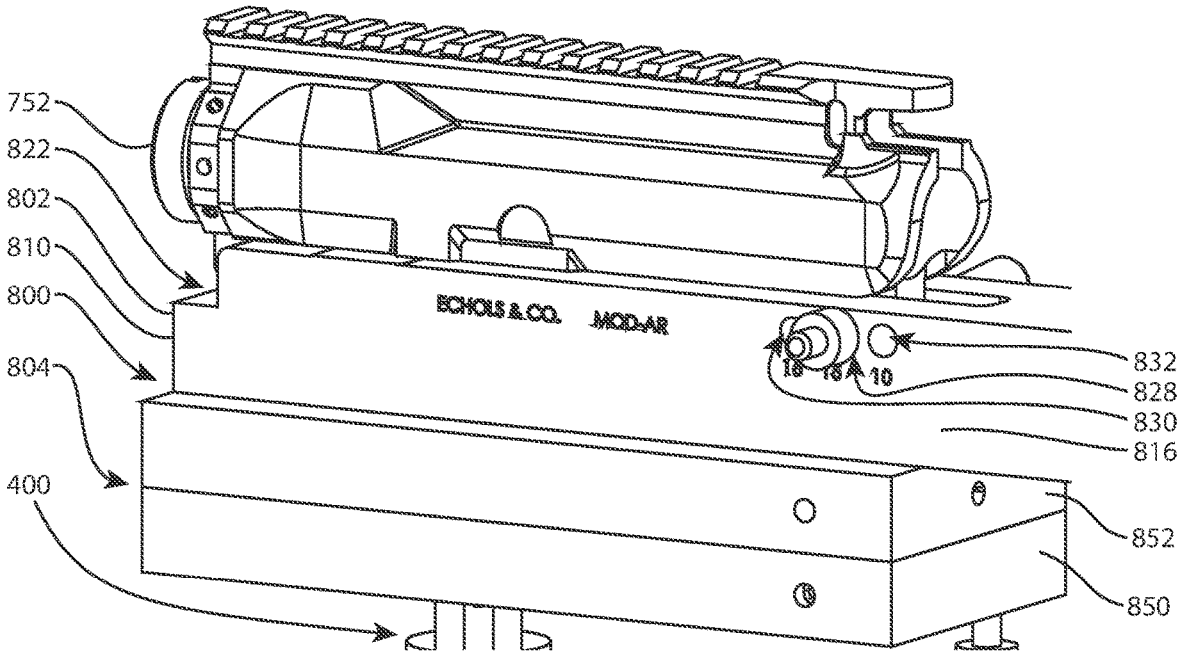
FIG. 59 is an oblique detail view of a portion of the AR action, third assembly, and rifle bench rest of FIG. 54.
Figure 60:
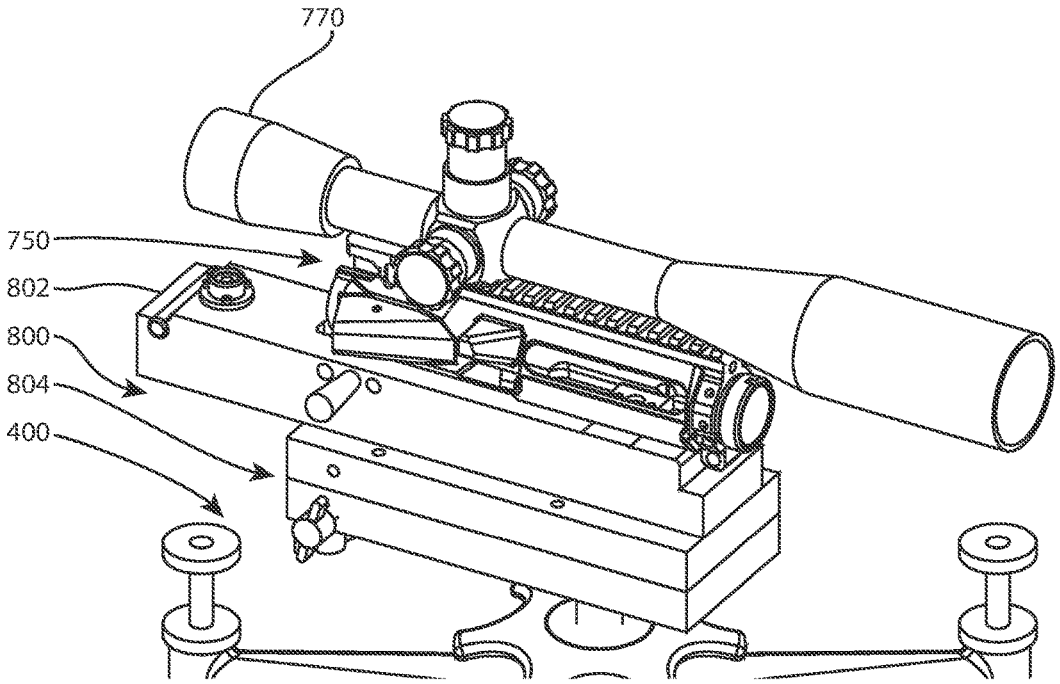
FIG. 60 is another oblique view of the AR action, scope, third assembly, and rifle bench rest of FIG. 54.
Figure 61:
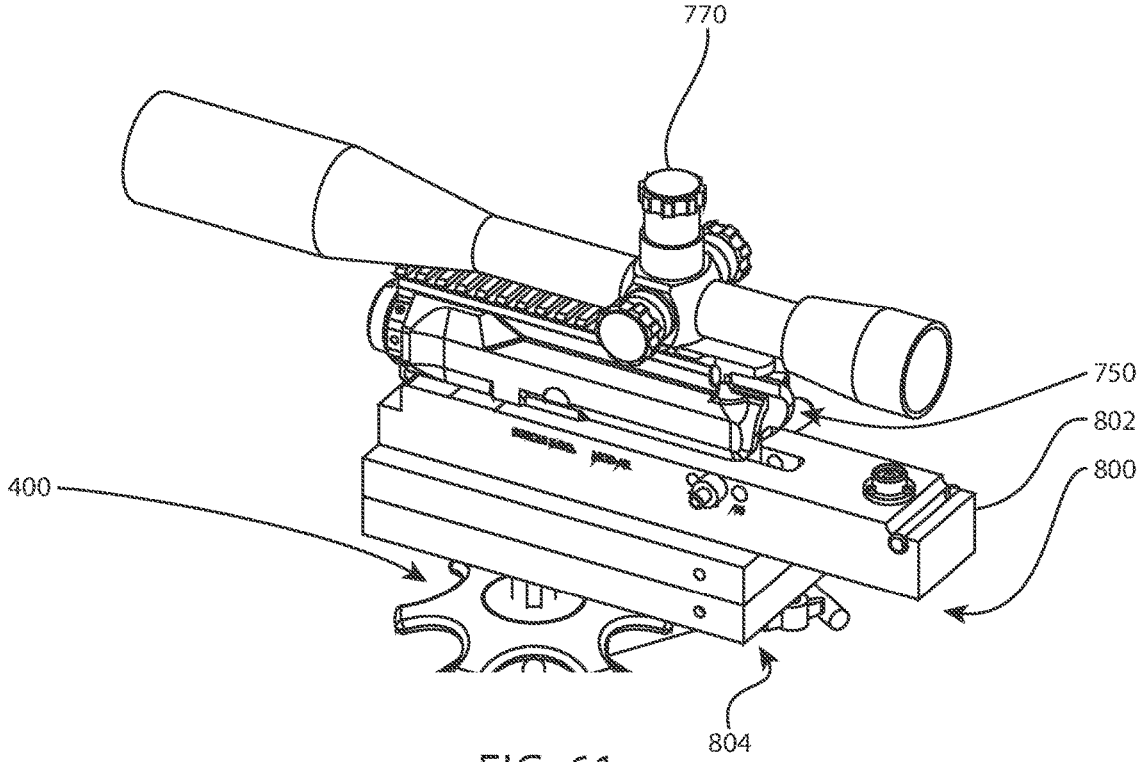
FIG. 61 is yet another oblique view of the AR action, scope, third assembly, and rifle bench rest of FIG. 54.

The adapter block 802 functions like the adapter blocks 306, 308, 310 to securely couple the AR receiver 752 to the plate sub-assembly 804. The adapter block 802 includes front, rear, right, left, top, and bottom sides 810, 812, 814, 816, 818, 820. A transverse notch 822 may extend from right to left across the front side 810 and the top side 818 to provide clearance for the front takedown boss 756 of the receiver 752 when the bottom surface 754 is against the top side 818. A boss 824 may extend upwardly from the top side 818. The boss 824 may be sized, shaped, and located to be received within the chamber 764 of the receiver 752, preferably within a front region of the chamber 764 near the front takedown boss 756. A substantially rectangular boss 824 is illustrated. The boss 756 may fit within the chamber 764 with generous front and back clearance and little to no right and left clearance. A slot 826 may extend into the top side 818, and may be sized, shaped, and located to receive the rear takedown boss 758 of the receiver 752 when the bottom surface 754 is against the top side 818. The slot 826 may include generous front and back clearance and little to no right and left clearance relative to the rear takedown boss 758. A transverse hole 828 may extend from right to left through the adapter block 802 and crossing the slot 826. The hole 828 may be sized, shaped, and located to receive the rear takedown pin 766 when the bottom surface 754 is against the top side 818 and the rear takedown boss 758 is in the slot 826. Additional transverse holes 830, 832 are shown in front of and in back of the hole 828; the additional holes 830, 832 may be provided to accommodate AR receivers with different rear takedown boss locations. A group of three holes 834, 836, 838 may extend from top to bottom through the adapter block 802, which may function like the group of holes 382, 384, 386 of the body 340 of the adapter block base sub-assembly 304 to receive fastener 344 and pins 346, 348 to couple the adapter block 802 to the plate sub-assembly 804. The holes 834, 836, 838 are shown extending through the boss 824 in this example. A hole 840 may extend from top to bottom through the adapter block 802, to the rear of hole 838. The hole 840 may receive a fastener to further couple the adapter block 802 to the plate sub-assembly 804. Referring to FIG. 56, the adapter block 802 may include the bullseye level 104 secured by the screws 114, 116, 118 and the tube level 106 secured by the set screws 120, 122, as described for the first assembly 100.

The plate sub-assembly 804 functions like the plate sub-assembly 302, including coupling to the main column 402 of the rifle bench rest 400, coupling to the adapter block 802, and providing a windage fine adjustment mechanism. The plate sub-assembly 804 may include a first plate 850 and a second plate 852, and may use fasteners 324, 326, 328, 330, spring plunger 332, and pin 334. The first plate 850 may be referred to as a lower plate and the second plate 852 may be referred to as a top plate. The first plate 850 may couple to the rifle bench rest 400. The second plate 852 may couple to the adapter block 802. The first and/or second plate 850, 852 may include an optional bullseye level or tube level (not shown) for preliminary leveling. The plate sub-assembly 804 may be operatively assembled by a method similar to that described above for the plate sub-assembly 302.

Figure 54:
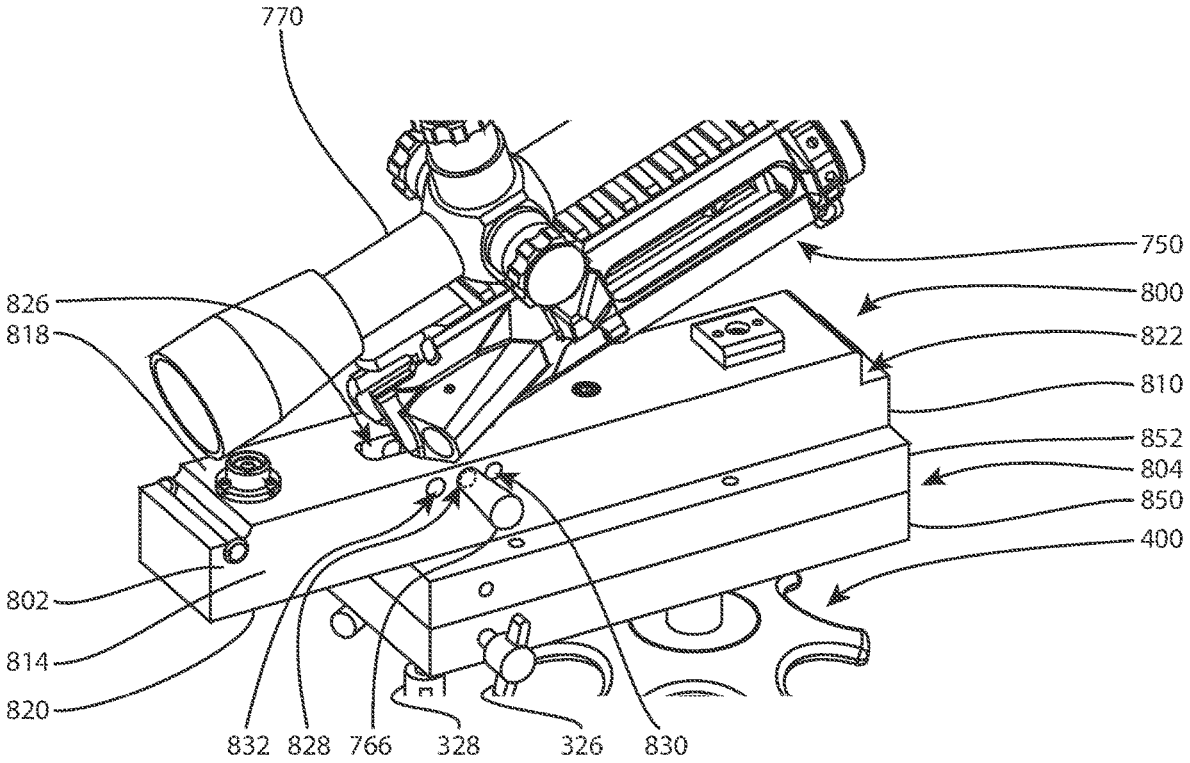
FIG. 54 is an oblique view of the AR action of FIG. 53 coupled to a scope, the AR action being coupled to a third assembly, referred to as an AR sighting holder, the third assembly coupled to a rifle bench rest.
Figure 55:
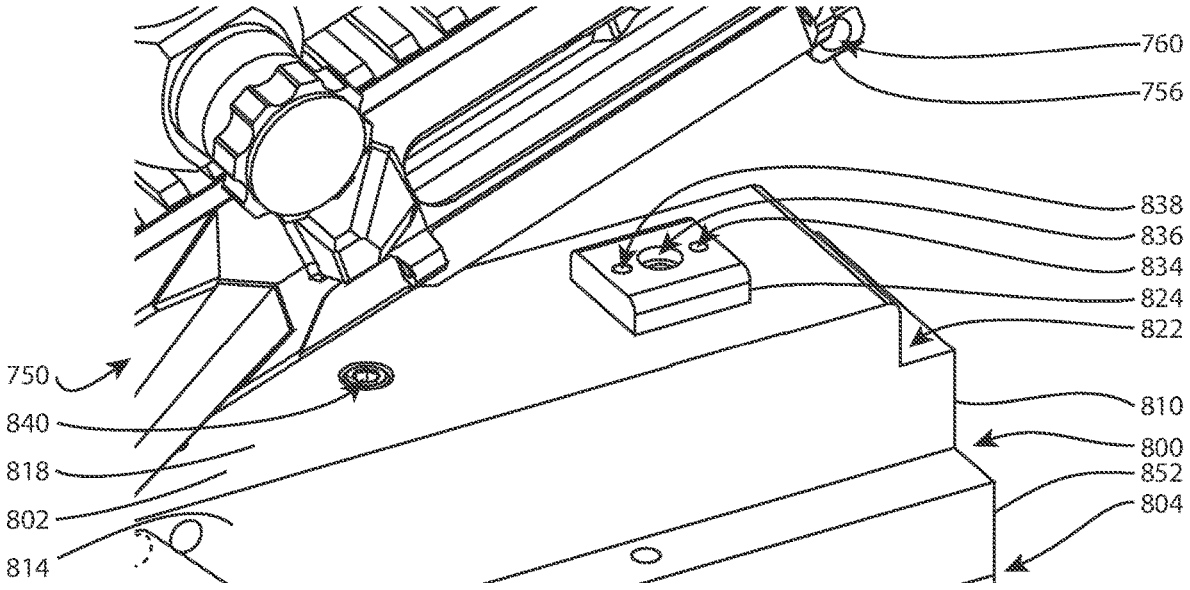
FIG. 55 is an oblique detail view of a portion of the AR action and third assembly of FIG. 54.

Referring to FIGS. 54-55, the receiver 752 may be operatively assembled to the adapter block 802 by orienting the receiver and adapter block with the front ends facing the same way, and the bottom surface 754 of the receiver facing the top side 818 of the adapter block; inserting the rear takedown boss 758 into the slot 826; aligning the rear takedown hole 762 with the hole 828; inserting the rear takedown pin 766 through the holes 762, 828; inserting the boss 824 into the chamber 764; receiving the front takedown boss 756 in the notch 822; and placing the bottom surface 754 against the top side 818. The steps of inserting the rear takedown boss 758 into the slot 826, aligning the rear takedown hole 762 with the hole 828, and inserting the rear takedown pin 766 through the holes 762, 828 may be performed with the front end of the receiver 752 tilted up as shown. The nominal dimensions and tolerances between the receiver 752 and adapter block 802 may be selected so that when the receiver is assembled to the adapter block, the bottom surface 754 is in surface contact with the top side 818, in other words, has at least three points of mutual contact. Thus, the top side 818 may function as a primary planar datum surface of the adapter block 802. While this description is made in the context of a continuous flat planar top side 818, it is contemplated that the top side 818 may instead comprise discontinuous patches, or points, for contacting the bottom surface 754. Taken together, the discontinuous patches or points may function as a primary planar datum surface. Whether the top side 818 is continuous or discontinuous, the top side 818 preferably contacts the full length of the bottom surface 754 between the between the front and rear takedown bosses 756, 758.

The adapter block 802 may be operatively assembled to the plate sub-assembly 804 by a method similar to that described for the adapter block 310, the adapter block base sub-assembly 304, and the plate sub-assembly 302, modified of course due to the adapter block 802 incorporating features of the adapter block base sub-assembly 304.

The methods of using the third assembly 800 to first precisely level the AR receiver 752 and then precisely level the reticles of the scope 770 are according to the principles laid out above for the first and second assemblies 100, 300.

All parts of the apparatus described herein are preferably fabricated from substantially rigid materials, for example metals or ceramics, except for parts that are described as compliant, elastic, deformable, springs, and the like.

Any methods disclosed herein includes one or more steps or actions for performing the described method. The method steps and/or actions may be interchanged with one another. In other words, unless a specific order of steps or actions is required for proper operation of the embodiment, the order and/or use of specific steps and/or actions may be modified.

Reference throughout this specification to "an embodiment" or "the embodiment" means that a particular feature, structure or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, as the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

Recitation in the claims of the term "first" with respect to a feature or element does not necessarily imply the existence of a second or additional such feature or element. Elements recited in means-plus-function format are intended to be construed in accordance with 35 U.S.C. § 112 Para. 6. It will be apparent to those having skill in the art that changes may be made to the details of the above-described embodiments without departing from the underlying principles of the technology.

While specific embodiments and applications of the present technology have been illustrated and described, it is to be understood that the technology is not limited to the precise configuration and components disclosed herein. Various modifications, changes, and variations which will be apparent to those skilled in the art may be made in the arrangement, operation, and details of the methods and systems of the present technology disclosed herein without departing from the spirit and scope of the technology.

The invention claimed is:

1. A system for leveling an AR action receiver, wherein the receiver comprises a central longitudinal axis, a chamber, and a planar bottom surface on a bottom side of the receiver, wherein the planar bottom surface comprises a first planar datum surface that is parallel to the central longitudinal axis, wherein the chamber is a cavity which extends into the receiver from the bottom side of the receiver between a front takedown boss and a rear takedown boss, the system comprising:

an AR sighting assembly comprising a block and a first level, wherein the AR sighting assembly is removably connectable to the receiver;

wherein the block extends between a front end and an opposite back end, wherein the block comprises a second planar datum surface that extends between the front and back ends on a top side of the block;

wherein the first level is fixed to the block and is level with respect to the second planar datum surface;

wherein when the AR sighting assembly is connected to the receiver, the first and second planar datum surfaces are in direct contact, and the front takedown boss and the rear takedown boss extend below the second planar datum surface.

2. The system of claim 1, wherein the first planar datum surface extends between a first front edge and an opposite first back edge;

wherein the second planar datum surface extends between a second front edge and an opposite second back edge;

wherein, when the AR sighting assembly is connected to the receiver, the second front edge is behind the first front edge, and the second back edge is behind the first back edge.

3. The system of claim 1, wherein when the AR sighting assembly is connected to the receiver, the rear takedown boss is received in a slot which extends into the top side of the block.

4. The system of claim 1, wherein the first level is a bullseye spirit level, wherein the first level is omnidirectionally level with respect to the second planar datum surface.

5. The system of claim 4, wherein the AR sighting assembly comprises a second level that is fixed to the block and is level with respect to the second planar datum surface, wherein the second level is a tube spirit level;

wherein when the AR sighting assembly is connected to the receiver, the second level is elongated along a direction that is perpendicular to the receiver central longitudinal axis.

6. The system of claim 1, further comprising:

a plate assembly comprising a lower plate, an upper plate, and a windage fine adjustment mechanism;

wherein the lower plate is removably connectable to a main column of a firearm bench rest;

wherein the upper plate is removably connectable to the receiver;

wherein the windage fine adjustment mechanism is actuatable to pivot the upper plate right or left relative to the lower plate about a pivot axis.

7. The system of claim 6, wherein when the receiver is connected to the upper plate, the receiver central longitudinal axis intersects the pivot axis.

8. A system for leveling an AR action receiver, wherein the receiver comprises a central longitudinal axis and a chamber, wherein the chamber is a cavity which extends into a bottom side of the receiver and comprises a first planar datum surface that is parallel to the central longitudinal axis, wherein the first planar datum surface extends between a first front edge and an opposite first back edge, wherein a full length of the first planar datum surface extends parallel to the central longitudinal axis between the first front and back edges, the system comprising:

an AR sighting assembly comprising a block and a first level, wherein the AR sighting assembly is removably connectable to the receiver;

wherein the block comprises a second planar datum surface that extends between a second front edge and an opposite second back edge;

wherein the first level is fixed to the block and is level with respect to the block second planar datum surface;

wherein when the AR sighting assembly is connected to the receiver, the first and second planar datum surfaces are in direct contact, and the full length of the first planar datum surface contacts the second planar datum surface.

9. The system of claim 8, wherein when the AR sighting assembly is connected to the receiver, the second front edge is behind the first front edge, and the second back edge is behind the first back edge.

10. The system of claim 8, wherein the bottom side of the receiver comprises a front takedown boss and a rear takedown boss; wherein when the AR sighting assembly is connected to the receiver, the rear takedown boss is received in a slot which extends into the top side of the block.

11. The system of claim 8, wherein the first level is a bullseye spirit level, wherein the first level is omnidirectionally level with respect to the second planar datum surface.

12. The system of claim 11, wherein the AR sighting assembly comprises a second level that is fixed to the block and is level with respect to the second planar datum surface, wherein the second level is a tube spirit level;

wherein when the AR sighting assembly is connected to the receiver, the second level is elongated along a direction that is perpendicular to the receiver central longitudinal axis.

13. The system of claim 8, further comprising:

a plate assembly comprising a lower plate, an upper plate, and a windage fine adjustment mechanism;

wherein the lower plate is removably connectable to a main column of a firearm bench rest;

wherein the upper plate is removably connectable to the receiver;

wherein the windage fine adjustment mechanism is actuatable to pivot the upper plate right or left relative to the lower plate about a pivot axis.

14. The system of claim 13, wherein when the receiver is connected to the upper plate, the receiver central longitudinal axis intersects the pivot axis.

15. A method of leveling an AR action receiver, wherein the receiver comprises a central longitudinal axis, a chamber, and a planar bottom surface on a bottom side of the receiver, wherein the planar bottom surface comprises a first planar datum surface that is parallel to the central longitudinal axis, wherein the chamber is a cavity which extends into the receiver from the bottom side of the receiver between a front takedown boss and a rear takedown boss, the method comprising the steps of:

providing an AR sighting assembly comprising a block and a first level, wherein the block extends between a front end and an opposite back end, and comprises a second planar datum surface that extends between the front and back ends on a top side of the block, wherein the first level is fixed to the block and is level with respect to the second planar datum surface, wherein the first level comprises a first bubble;

coupling the AR sighting assembly to the receiver so that the first and second planar datum surfaces are in direct contact, the front takedown boss and the rear takedown boss extend below the second datum planar surface; and adjusting the orientation of the receiver so that the first bubble is centered in the first level.

16. The method of claim 15, further comprising the steps of:

coupling a scope to the receiver, wherein the scope comprises a vertical reticle;

providing a true vertical datum downrange of the receiver; and after adjusting the orientation of the receiver so that the first bubble is centered in the first level, adjusting the orientation of the scope to align the vertical reticle to the true vertical datum while maintaining the first bubble centered in the first level; and fixing the scope to the receiver while maintaining the first bubble centered in the first level and the vertical reticle aligned to the true vertical datum.

17. The method of claim 15, wherein the first planar datum surface extends between a first front edge and an opposite first back edge, wherein the second planar datum surface extends between a second front edge and an opposite second back edge, the method further comprising the steps of:

coupling the AR sighting assembly to the receiver so that the second front edge is behind the first front edge, and the second back edge is behind the first back edge.

18. The method of claim 15, further comprising the steps of:

coupling the AR sighting assembly to the receiver so that the rear takedown boss is received in a slot which extends into the top side of the block.

19. The method of claim 15, further comprising the steps of:

providing a plate assembly comprising a lower plate, an upper plate, and a windage fine adjustment mechanism, wherein the windage fine adjustment mechanism is actuatable to pivot the upper plate right or left relative to the lower plate about a pivot axis;

coupling the lower plate to a main column of a firearm bench rest; and coupling the upper plate to the receiver;

wherein adjusting the orientation of the receiver so that the first bubble is centered in the first level comprises adjusting the elevation of the receiver central longitudinal axis by adjusting the bench rest, and adjusting the windage of the receiver central longitudinal axis by adjusting the windage fine adjustment mechanism.

20. The method of claim 19, wherein the first level is a bullseye spirit level, wherein adjusting the orientation of the receiver so that the first bubble is centered in the first level comprises omnidirectionally adjusting the orientation of the receiver, the method further comprising the steps of:

coupling a scope to the receiver, wherein the scope comprises a vertical reticle;

providing a true vertical datum downrange of the receiver;

after adjusting the orientation of the receiver so that the first bubble is centered in the first level, adjusting the orientation of the scope to align the vertical reticle to the true vertical datum while maintaining the first bubble centered in the first level; and fixing the scope to the receiver while maintaining the first bubble centered in the first level and the vertical reticle aligned to the true vertical datum.

* * * * *